US006695532B2

(12) United States Patent
Somero et al.

(10) Patent No.: US 6,695,532 B2
(45) Date of Patent: Feb. 24, 2004

(54) CONCRETE FINISHING APPARATUS

(75) Inventors: David W. Somero, New Ipswich, NH (US); David M. Somero, New Ipswich, NH (US); Philip J. Quenzi, Atlantic Mine, NH (US); Philip D. Halonen, Calumet, MI (US); Mark A. Pietila, Atlantic Mine, MI (US); Carl B. Kieranen, Laurium, MI (US); Paul H. Poyhonen, Calumet, MI (US); Robert A. Peterson, Atlantic Mine, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/166,507

(22) Filed: Jun. 10, 2002

(65) Prior Publication Data

US 2002/0192026 A1 Dec. 19, 2002

Related U.S. Application Data

(60) Provisional application No. 60/298,054, filed on Jun. 13, 2001.

(51) Int. Cl.[7] ..... E01C 19/26

(52) U.S. Cl. ..... 404/118; 404/75

(58) Field of Search ..... 404/75, 84.5, 103, 404/114, 118, 120

(56) References Cited

U.S. PATENT DOCUMENTS

| | | | | |
|---|---|---|---|---|
| 1,731,231 | A | 10/1929 | Chenoweth | |
| 1,736,412 | A | 11/1929 | Lichtenberg | |
| 1,736,413 | A | 11/1929 | Lichtenberg | |
| 1,755,653 | A | 4/1930 | Koehring | |
| 2,025,703 | A | 12/1935 | Baily et al. | 94/48 |
| 2,266,655 | A | 12/1941 | Naget | 94/50 |
| 2,650,525 | A | 9/1953 | Jones | 94/45 |
| 3,009,401 | A | 11/1961 | Greiner | 94/50 |
| 3,072,025 | A | 1/1963 | Cronin | 94/50 |
| 3,306,175 | A | 2/1967 | Ferwerda | 94/50 |
| 3,402,648 | A | 9/1968 | Modesto et al. | 94/45 |
| 3,477,535 | A | 11/1969 | Wyatt | 180/20 |
| 3,698,293 | A | 10/1972 | Wagner | 94/50 |
| 3,870,427 | A | 3/1975 | Allen | 404/103 |
| 4,043,738 | A | 8/1977 | Modesto et al. | 425/456 |
| 4,115,976 | A | 9/1978 | Rohrer | 52/741 |
| 4,142,815 | A | 3/1979 | Mitchell | 404/103 |
| 4,157,877 | A | 6/1979 | Lee | 404/128 |
| 4,167,360 | A | 9/1979 | Dick, Jr. | 405/271 |

(List continued on next page.)

OTHER PUBLICATIONS

Somero Enterpises Ltd. Model S–240 (with Concrete Pumping News), 1987.*

Formconsult AB Sweden website, 1998.

*Primary Examiner*—Robert E. Pezzuto
*Assistant Examiner*—Tara L. Mayo
(74) *Attorney, Agent, or Firm*—Van Dyke, Gardner, Linn & Burkhart, LLP

(57) ABSTRACT

A concrete finishing apparatus and method for smoothing and flattening partially cured concrete to a close-tolerance surface includes a movable unit which is movable and entirely supported on or over a partially cured concrete surface and at least one rotatable finishing member, such as a cylindrical tube, roller or the like, mounted to the movable unit. The rotatable finishing member is positioned at the partially cured concrete surface and rotatable to engage and finish the surface of the partially cured concrete to a high quality, close-tolerance flat and level concrete floor surface. The rotatable finishing member is preferably rotatable in a direction generally opposite to the direction of travel of the movable unit to enhance the finishing process and to carry any cement paste or residue forward with the finishing member to fill in any low areas as the concrete finishing apparatus moves over the partially cured concrete.

53 Claims, 14 Drawing Sheets

U.S. PATENT DOCUMENTS

| | | | | |
|---|---|---|---|---|
| 4,231,678 | A | 11/1980 | Carternock | 404/103 |
| 4,280,800 | A | 7/1981 | Bunn | 425/62 |
| 4,345,888 | A | 8/1982 | Brunemann | 425/117 |
| 4,572,704 | A | 2/1986 | Allen | 404/114 |
| 4,614,486 | A | 9/1986 | Bragagnini | 425/62 |
| 4,655,633 | A | 4/1987 | Somero et al. | 404/75 |
| 4,661,011 | A | 4/1987 | Halim | 404/124 |
| 4,702,640 | A | 10/1987 | Allen | 404/75 |
| 4,712,943 | A | 12/1987 | Alvarsson | 404/75 |
| 4,737,050 | A | 4/1988 | Abd. El Halim | 404/75 |
| 4,747,726 | A | 5/1988 | Garner et al. | 404/123 |
| 4,775,306 | A | 10/1988 | Kikuchi et al. | 425/62 |
| 4,913,584 | A | 4/1990 | Garner et al. | 404/123 |
| 4,930,935 | A | 6/1990 | Quenzi et al. | 404/75 |
| 4,964,754 | A | 10/1990 | Garner et al. | 404/123 |
| 4,978,246 | A | 12/1990 | Quenzi et al. | 404/84 |
| 4,993,869 | A | 2/1991 | Ulmer et al. | 404/117 |
| 5,039,249 | A | 8/1991 | Hansen et al. | 404/84 |
| 5,046,889 | A | 9/1991 | Sterner, Jr. | 404/103 |
| 5,061,115 | A | 10/1991 | Godbersen et al. | 404/102 |
| 5,062,738 | A | 11/1991 | Owens | 404/114 |
| 5,088,855 | A | 2/1992 | Giliberti | 404/103 |
| 5,190,400 | A | 3/1993 | Sterner | 404/103 |
| 5,228,799 | A | 7/1993 | Sondreal | 404/124 |
| 5,281,050 | A | 1/1994 | Howard | 404/120 |
| 5,311,727 | A | 5/1994 | Fassauer | 56/12.8 |
| 5,328,295 | A | 7/1994 | Allen | 404/84.1 |
| 5,456,549 | A | 10/1995 | Paladeni | 404/103 |
| 5,483,788 | A | 1/1996 | Fassauer | 56/12.1 |
| 5,507,593 | A | 4/1996 | Hollon et al. | 404/122 |
| 5,526,590 | A | 6/1996 | Palm et al. | 37/142.5 |
| 5,562,361 | A | 10/1996 | Allen | 404/103 |
| 5,664,908 | A | 9/1997 | Paladeni | 404/103 |
| 5,803,656 | A | 9/1998 | Turck | 404/103 |
| 5,971,656 | A * | 10/1999 | Kitsmiller | |
| 6,071,458 | A | 6/2000 | Mossi | 264/294 |
| 6,402,425 | B1 * | 6/2002 | Paladeni | |
| 6,530,720 | B1 * | 3/2003 | Green | |

* cited by examiner

CONCRETE FINISHING APPARATUS

CROSS REFERENCE TO RELATED APPLICATION

The present application claims priority on U.S. provisional application Ser. No. 60/298,054, filed Jun. 13, 2001 by Somero et al. for CONCRETE FINISHING APPARATUS, which is hereby incorporated herein by reference in its entirety.

FIELD OF THE INVENTION

The present invention relates generally to a concrete finishing, smoothing and/or leveling apparatus and, more particularly, to a concrete smoothing and leveling apparatus which is operable on partially cured concrete to smooth the partially cured concrete surface to a flat, level surface.

BACKGROUND OF THE INVENTION

There is a growing need in the industry for close-tolerance, flat and level concrete floors for various buildings or structures, such as warehouses, manufacturing facilities and the like. Many manufacturing plants include high-precision equipment which must be level and thus benefit from having close-tolerance floors to allow for easier initial installation, set up and/or reorganization of the equipment. Additionally, high-density warehouse facilities often utilize narrow aisles and high-reach forklifts to reach tall storage racks for shelving. Any offset from level of the floor then corresponds to an offset from vertical of the high-reach forklift, which may result in difficulty in maneuvering the forklifts along the aisles and in reaching the upper shelves. Such warehouse facilities thus also benefit from very smooth and accurately level floors for efficient installation and use of equipment and for stocking of the shelves.

Close-tolerance floors are often referred to in the industry as "super-flat floors" or simply "super flats". Such super-flat floors are typically expensive for concrete contractors to produce, since such projects usually require specialized equipment and experienced personnel with a thorough knowledge of the process. Because of the high cost of the super-flat floors, often only specified areas of a building floor will be made to super-flat specifications, such as within anticipated aisleways of a given floor plan. However, the spacing or location of the aisles then cannot be easily adjusted later, which increases future renovation costs and possibly the future value and usefulness of the facility.

Close-tolerance, super-flat concrete floors are specified, measured and compared in the concrete industry according to concrete floor profile specification variables. One of these variables is for floor flatness "F-F" and another is for floor levelness "F-L". These two specifications together are generally referred to in the industry as F-numbers. The F-number system offers a repeatable method for measuring floor quality through statistical means known in the art. Concrete floors having F-numbers near or above the range of F-F 80 and F-L 80 are typically regarded as being super-flat concrete floors.

Super-flat concrete floors are much more difficult and expensive to achieve than those conventionally poured. In order to achieve such super-flat floors, construction work site personnel must be highly trained and skilled, and special equipment is often required to place and finish the concrete. Striking-off wet, uncured concrete to a specified grade for a conventional floor can be performed using hand tools. However, a large number of workers are required to finish the floor, and production speed of the floor is thus relatively slow with such conventional processes. Additionally, as an operator continues to work with the manual devices, such as trowels and scrapers, for a long period of time, the operator will tire as the day goes on, which will have an adverse affect on the final F-numbers and quality of the floor. Therefore, because many flat floors are finished by manual labor, the floors are likely to have relatively poor accuracy in the overall surface levelness and flatness.

In many applications, the use of a laser screeding device, such as the Somero Laser Screed, developed by Somero Enterprises of Houghton, Mich., is often required when the goal of a super-flat floor is to be achieved. Other special application tools and equipment, such as highway straight edges, power trowels, pan machines and double trowels, may be used separately, at the same time, or in combination with one another, during the finishing process. Because a significant amount of time and effort of experienced and skilled workers and special equipment and/or machinery is required to achieve a super-flat floor quality, achieving such a floor is often a relatively expensive and time consuming process.

Many concrete processing applications have implemented a spinning tube, or the like, in constructing a concrete floor or surface. However, such spinning tube applications are implemented as an initial strike-off tool or screed for striking-off or screeding freshly placed and uncured concrete to the desired grade. These tube type roller screeds are necessarily supported on some type of preset forms or screed rails to maintain grade height. Because these screeding devices are applicable only to freshly poured, uncured concrete, implementation of such devices does not result in a close-tolerance or super-flat concrete floor surface. The additional manual processes still have to be performed on the surface after the initial screeding operation is completed, and after the concrete is at least partially cured and set up, in order to obtain such a super-flat, high quality, floor surface.

Therefore, there is a need in the art for a concrete smoothing and leveling apparatus which is capable of finishing a concrete surface to a super-flat or close-tolerance finish. The apparatus should require minimal manual labor processes and be inexpensive to operate over the entire floor surface.

SUMMARY OF THE INVENTION

The present invention is intended to provide a concrete floor or surface finishing apparatus which is operable to finish a surface of a partially cured concrete slab to a super-flat, smooth and level floor surface. The apparatus of the present invention requires minimal manual labor processes to achieve the desired floor surface quality. Additionally, the apparatus of the present invention is applicable to large floor surface areas, whereby the entire floor surface can achieve the desired super-flat and level floor qualities.

According to a first aspect of the present invention, a concrete finishing apparatus for smoothing and leveling partially cured concrete at a support surface includes a movable unit and at least one rotatable finishing member mounted at the movable unit. The movable unit is movable and supported over and/or on the partially cured concrete and is movable in at least a first direction. The at least one rotatable finishing member is an elongated cylindrical member, such as a cylindrical tube, roller, cylinder or the like. The rotatable finishing member includes a longitudinal axis and is rotatable about the longitudinal axis. The rotatable finishing member defines a cylindrical contact surface therealong which is adapted to contact a surface of the partially cured concrete as the rotatable finishing member is rotated over the partially cured concrete. The finishing member is rotatable such that the contact surface moves relative to the surface of the partially cured concrete as the movable unit and the rotatable finishing member are moved over the partially cured concrete.

Preferably, the rotatable finishing member is positioned behind the movable unit as the movable unit moves in the first direction. The finishing member is rotatable in an opposite direction from the first direction such that the contact surface is movable relative to the partially cured concrete surface in the first direction as the movable unit moves in the first direction.

In one form, the rotatable finishing member is vertically adjustable. Optionally, the concrete finishing apparatus may include a laser leveling system. The rotatable finishing member is then vertically adjustable in response to the laser leveling system. The rotatable finishing member may also or otherwise be variably weighted to adjust or vary an amount of force or downward pressure being applied to the partially cured concrete by the rotatable finishing member.

The movable unit of the concrete finishing apparatus includes at least one support which spreads the weight of the movable unit over an area of the partially cured concrete to limit depression of the partially cured concrete by the movable unit. In one form, the at least one support includes at least four inflatable tires. In another form, the at least one support includes at least two elongated rollers which are rotatable to move the movable unit over the concrete surface. In yet another form, the at least one support includes at least two continuous tracks.

Alternately, the movable unit may include only one tire, wheel or roller, or two generally coaxial tires, wheels or rollers, such that the rotatable finishing member is substantially supported on the partially cured concrete surface due to the weight of the finishing member. Alternately, the movable unit may include an air cushion unit which is operable to be supported above the concrete surface via a cushion of air generated by the air cushion unit. It is further envisioned that the movable unit may be a power trowel or riding trowel apparatus, with the rotatable finishing member mounted at a rearward end of the power trowel, without affecting the scope of the present invention.

The concrete finishing apparatus of the present invention may include two rotatable finishing members positioned at opposite ends of the movable unit. One of the two rotatable finishing members then may be lowered to contact and smooth the partially cured concrete surface when the movable unit is moved in the first direction, while the other of the two rotatable finishing members is lowered to contact and smooth the partially cured concrete surface when the movable unit is moved in a second direction. The second direction is generally opposite the first direction. Optionally, both rotatable finishing members may be lowered to engage and finish the partially cured concrete surface as the movable unit moves over and along the partially cured concrete surface.

The rotatable finishing member of the concrete finishing apparatus may be positioned relative to the movable unit such that the longitudinal axis of the rotatable finishing member is generally normal to the first direction. Alternately, the rotatable finishing member may be positioned relative to the movable unit such that the longitudinal axis of the finishing member is skewed or canted relative to the first direction, i.e., positioned at an angle to the first direction. Preferably, the orientation of the finishing member relative to the movable unit is adjustable in order to change the skew or angle of the rotatable finishing member depending on the application.

According to another aspect of the present invention, a method for finishing a concrete surface of partially cured concrete includes providing a concrete finishing apparatus having a movable support and a rotatable finishing member. The movable support and rotatable finishing member are moved over and/or on the concrete surface such that the movable support is supported on and/or over the partially cured concrete. The rotatable finishing member defines a generally cylindrical contact surface for contacting the concrete surface and is positioned at the concrete surface. The rotatable finishing member is rotated about a longitudinal axis of the finishing member to move the contact surface relative to the partially cured concrete surface as the movable support and the rotatable finishing member move over the concrete surface.

In one form, the method includes moving the movable support and the rotatable finishing member in a first direction. The method may further include rotating the rotatable finishing member to move the contact surface in the first direction. The method may also include positioning the rotatable finishing member behind the movable support as the movable support moves in the first direction.

During operation, the rotatable finishing member is preferably positioned and pulled behind the movable unit as the movable unit moves in the first direction. The rotatable finishing member is then rotatable in a generally opposite direction from the first direction, such that the contact surface is movable relative to the concrete surface in the first direction as the movable unit moves in the first direction. The rotational speed of the finishing member is selected such that the finishing member contact surface generates sufficient slippage over the partially cured concrete to smooth the concrete to a high quality finish.

The movable support may be ridden and driven by an operator, or manually moved over the partially cured concrete surface by an operator walking on the surface, or may be remotely controlled by a remote control device or programmable to move and finish the partially cured concrete surface in a programmed manner.

Therefore, the present invention provides a concrete smoothing and finishing apparatus and method for smoothing partially cured concrete at a support surface to a super-flat, high quality finish. The apparatus is operable to provide a smooth finish over a large area and requires minimal manual processes. Accordingly, the present invention provides a more efficient and effective smoothing and finishing apparatus and method for achieving high quality, super-flat and level floor surfaces. In addition, the machine and process method of the present invention may also serve to significantly shorten the cure cycle time of the finished concrete surface such that in the overall perspective, less time, effort, and cost may be incurred by the construction contractor, while at the same time, improving the overall quality of the finished concrete surface.

These and other objects, advantages, purposes and features of this invention will become apparent upon review of the following specification in conjunction with the drawings.

DESCRIPTION OF THE PREFERRED EMBODIMENTS

Figure 1:
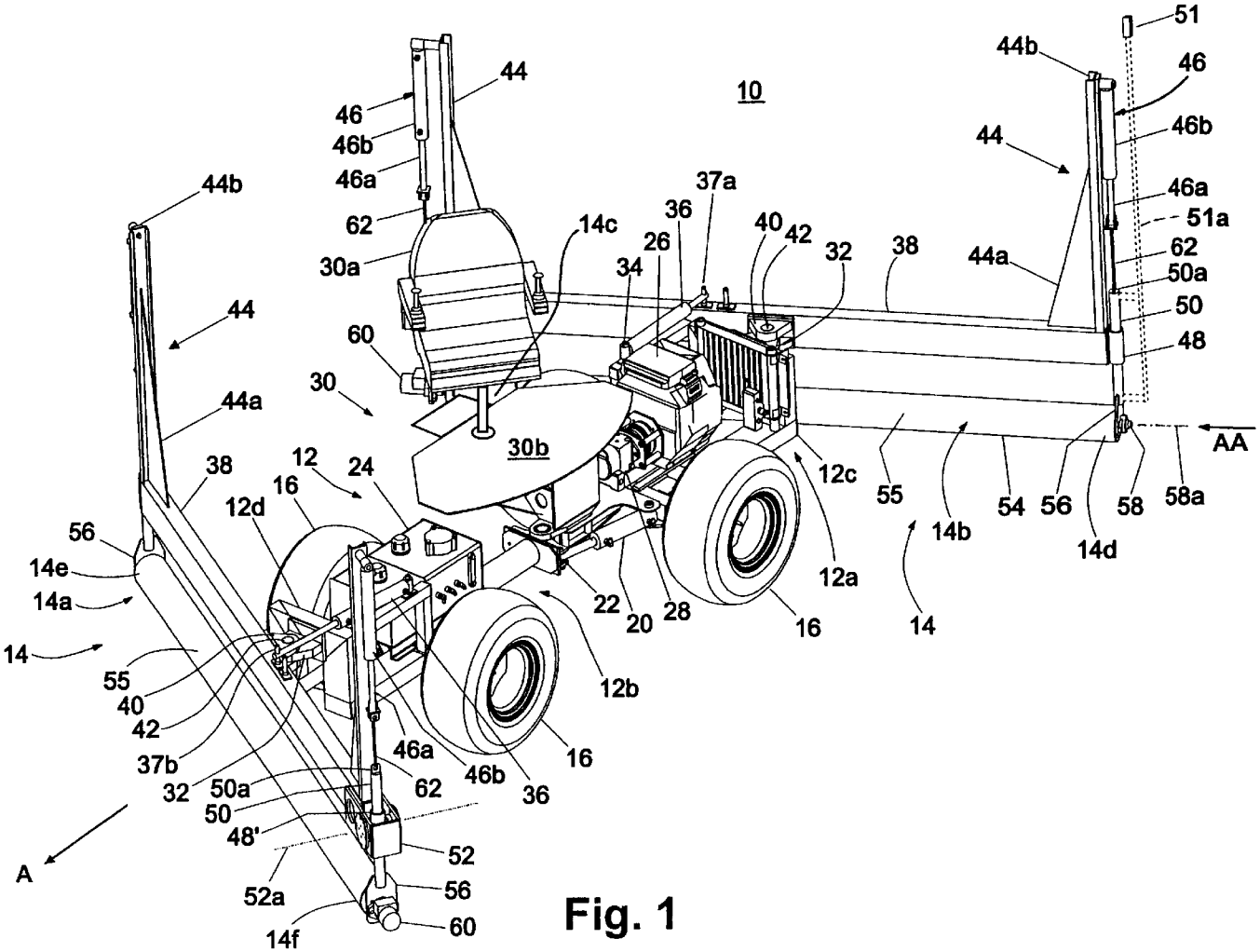
FIG. 1 is a perspective view of a concrete finishing apparatus in accordance with the present invention having a four-wheeled movable unit and having the rotatable finishing members skewed at an angle relative to the longitudinal axis and direction of motion of the movable unit.

Referring now specifically to the drawings and the illustrative embodiments depicted therein, a roller leveler concrete finishing apparatus or machine 10 includes a movable unit or support 12 and one or more rotatable, generally cylindrical finishing members 14, such as a pair of rotatable finishing members 14*a*, 14*b*, such as rollers, tubes or cylinders or the like, at opposite ends of the movable unit 12 (FIGS. 1–5). Movable unit 12 is movable over and supported on partially cured concrete, while at least one of the rotatable finishing members 14*a*, 14*b* contacts a surface of the partially cured concrete and rotates or spins over the concrete surface. The spinning finishing members 14 thus slip relative to the surface of the partially cured concrete to remove a thin layer of cement paste from the partially cured concrete surface to provide a high quality, smooth, flat and level surface. As movable unit 12 is moved in one direction, a rearward one of the rotatable finishing members is lowered such that the rotatable finishing member is in generally constant contact with the surface of the partially cured concrete. The rotatable finishing member is spun in a direction that is generally opposite to the direction of travel of the machine, such that the thin layer of cement paste removed by the finishing member is carried to a forward side of the finishing member, just ahead of the spinning finishing member. This allows the excess cement paste to drop off and fill in any low areas or depressions, or any area that is otherwise below the desired grade, as the spinning finishing member moves over such areas. Concrete finishing machine or apparatus 10 thus provides a close-tolerance, super-flat concrete floor surface as it is driven over the partially cured concrete, as discussed in detail below.

In the illustrated embodiment of FIGS. 1–5, movable unit 12 is an articulated-wheeled vehicle having four wheels 16 for driving and supporting the movable unit over the partially cured concrete surface. The wheels may be independently drivable via hydraulic motors (not shown) or the like or may be chain driven or driven via any other drive means, without affecting the scope of the present invention. Preferably, wheels 16 of movable unit 12 include wide and smooth tires, such as balloon type tires or the like, which provide a larger contact surface or footprint on the surface of the partially cured concrete to limit depression or sinking of movable unit 12 into the partially cured concrete surface.

Figure 2:
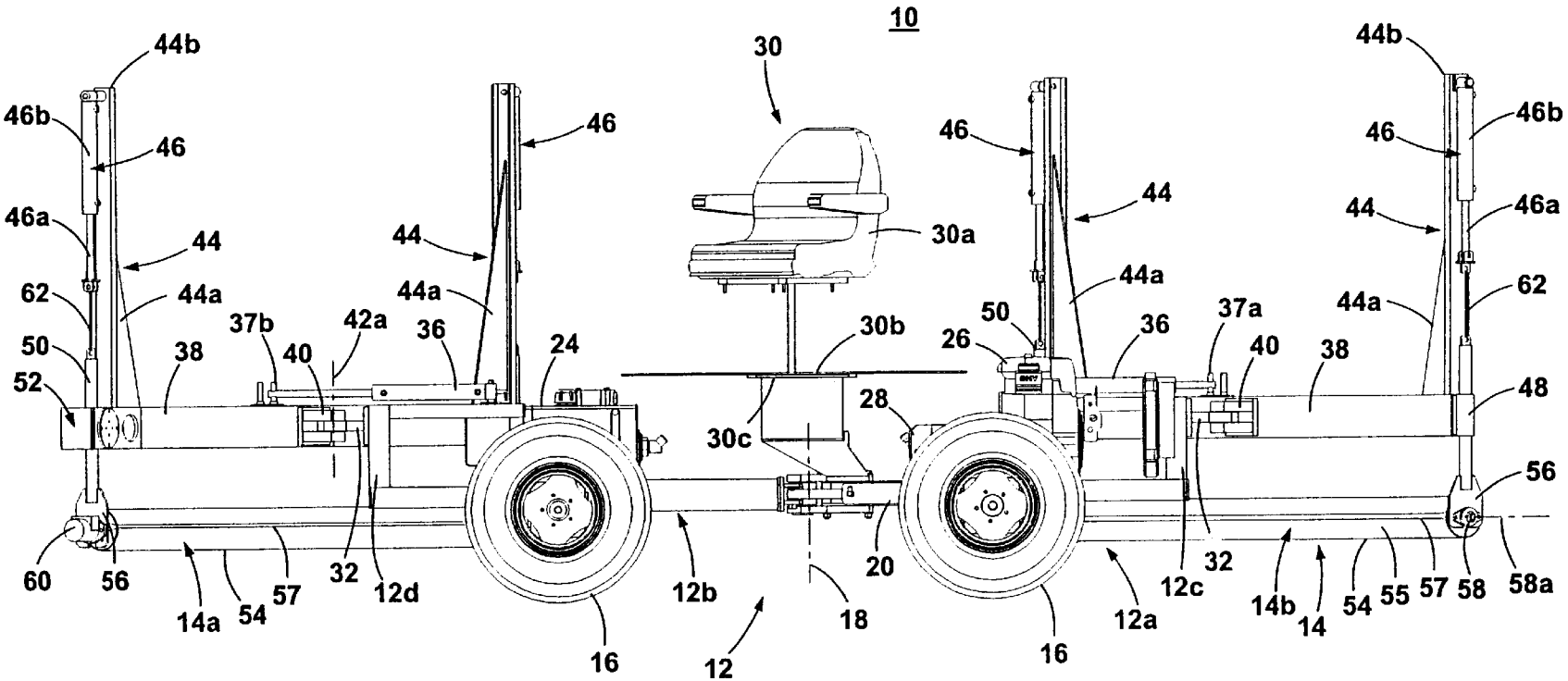
FIG. 2 is a side elevation of the concrete finishing apparatus of FIG. 1.
Figure 4:
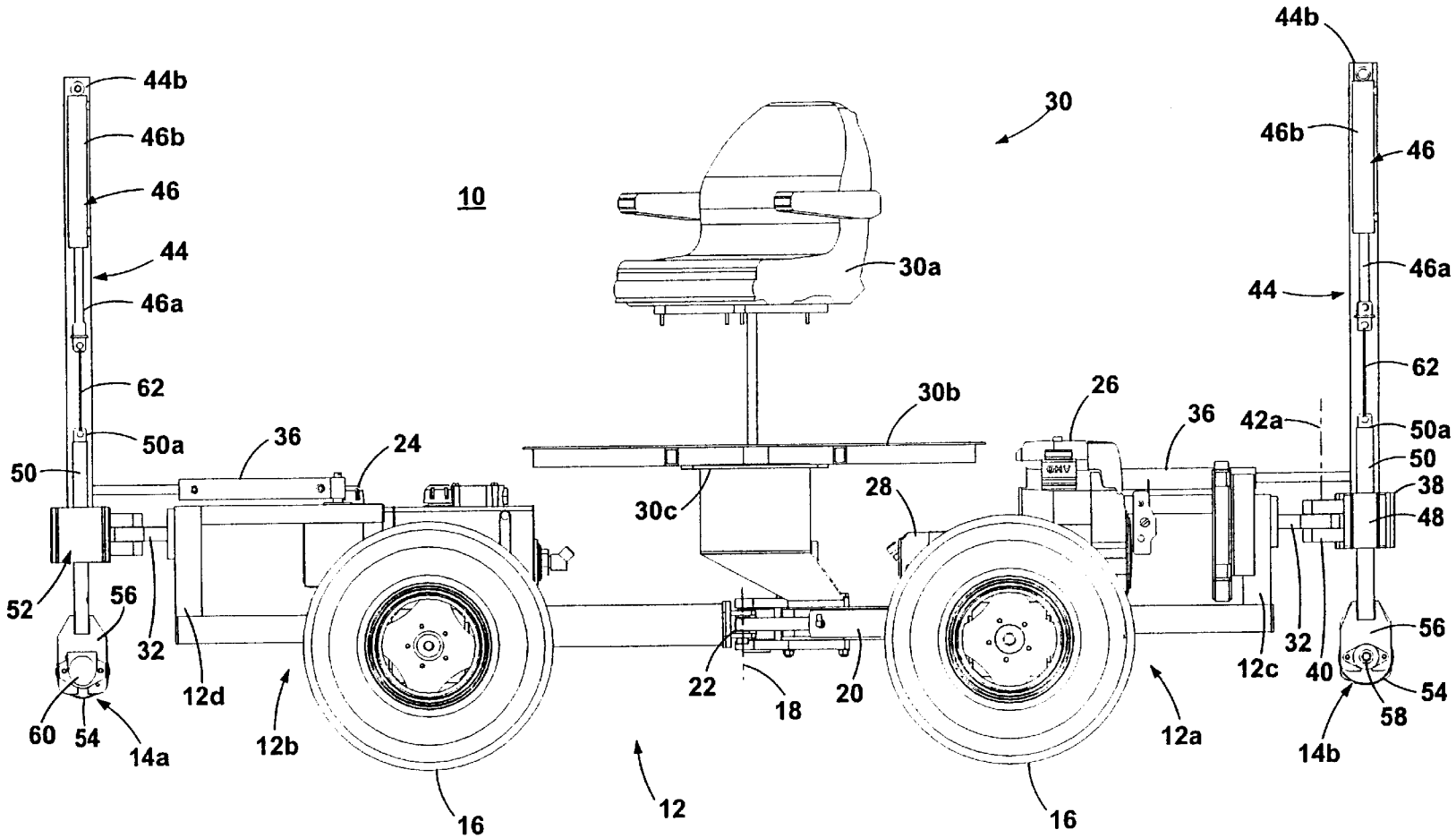
FIG. 4 is another side elevation of the concrete finishing apparatus of FIGS. 1–3, with the rotatable finishing members in the orientation of FIG. 3.

Movable unit or wheeled vehicle 12 is steerable via articulation of the unit about a generally central, generally vertically oriented, pivot axis 18 (FIGS. 2 and 4). An actuator or hydraulic cylinder 20 is preferably mounted on one portion, such as a rear portion 12*a* of movable unit 12, and is connected to a lever arm or moment arm 22 of the other portion, such as front portion 12*b*, of movable unit 12. Accordingly, extension and retraction of hydraulic cylinder 20 causes the front portion 12*b* to pivot about pivot axis 18 relative to rear portion 12*a* to steer the movable unit 12 as it is driven along the partially cured concrete surface.

Preferably, movable unit 12 includes an hydraulic reservoir 24 and engine 26 which powers an hydraulic pump 28 to provide pressurized fluid to the various hydraulic cylinders and hydraulic motors associated with concrete finishing apparatus 10, as discussed below. However, other driving means may be implemented, such as electrical devices or the like, without affecting the scope of the present invention.

Figure 5:
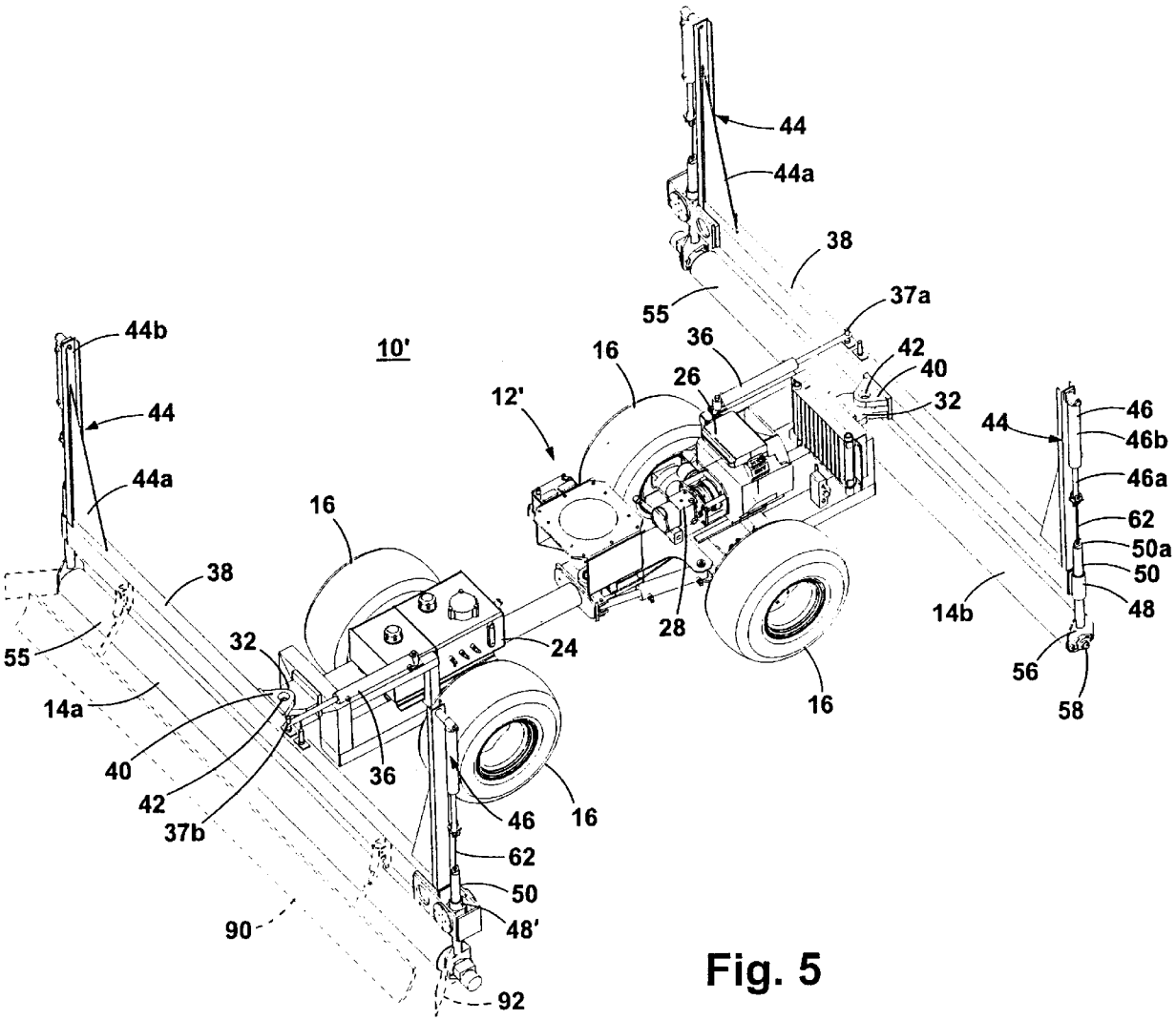
FIG. 5 is a perspective view similar to FIG. 3, with the seat removed from the concrete finishing apparatus and including an optional concrete cream scoop and end-wing plow.

As seen in FIGS. 1–4, movable unit 12 may include an operator station 30 for an operator to sit at and drive and control finishing apparatus 10. The operator station 30 may include a seat 30*a* and a platform 30*b* and manual controls for operating the concrete finishing apparatus. The platform 30*b* and seat 30*a* may be pivotally mounted to the movable unit, such as to the rear portion 12*a* of movable unit 12, via a rotatable turntable 30*c* (FIGS. 2 and 4) or the like, in order to allow the operator to turn the seat and platform so the operator is facing in the direction of travel of the movable unit. Alternately, as shown in FIG. 5, a concrete finishing apparatus 10' may include a movable unit 12' which does not include a place for a driver to sit or ride on, and may otherwise be controlled via remote control. Optionally, the concrete finishing apparatus may be programmable to perform the finishing processes in a controlled, programmed manner, without affecting the scope of the present invention.

Movable unit 12 includes a roller mounting bracket or mount 32 extending outwardly from both a rear end 12*c* and a front end 12*d* of movable unit 12 for mounting the rotatable finishing members or rollers 14*a*, 14*b* to the movable unit 12, as discussed in detail below. Additionally, a bracket or mount 34 is provided at or near each end of movable unit 12 for mounting an actuator or hydraulic cylinder 36 thereto. The hydraulic cylinder or cylinders 36 are operable to pivot or adjust the orientation of the rotatable finishing members 14*a*, 14*b* relative to movable unit 12, as also discussed below.

Figure 3:
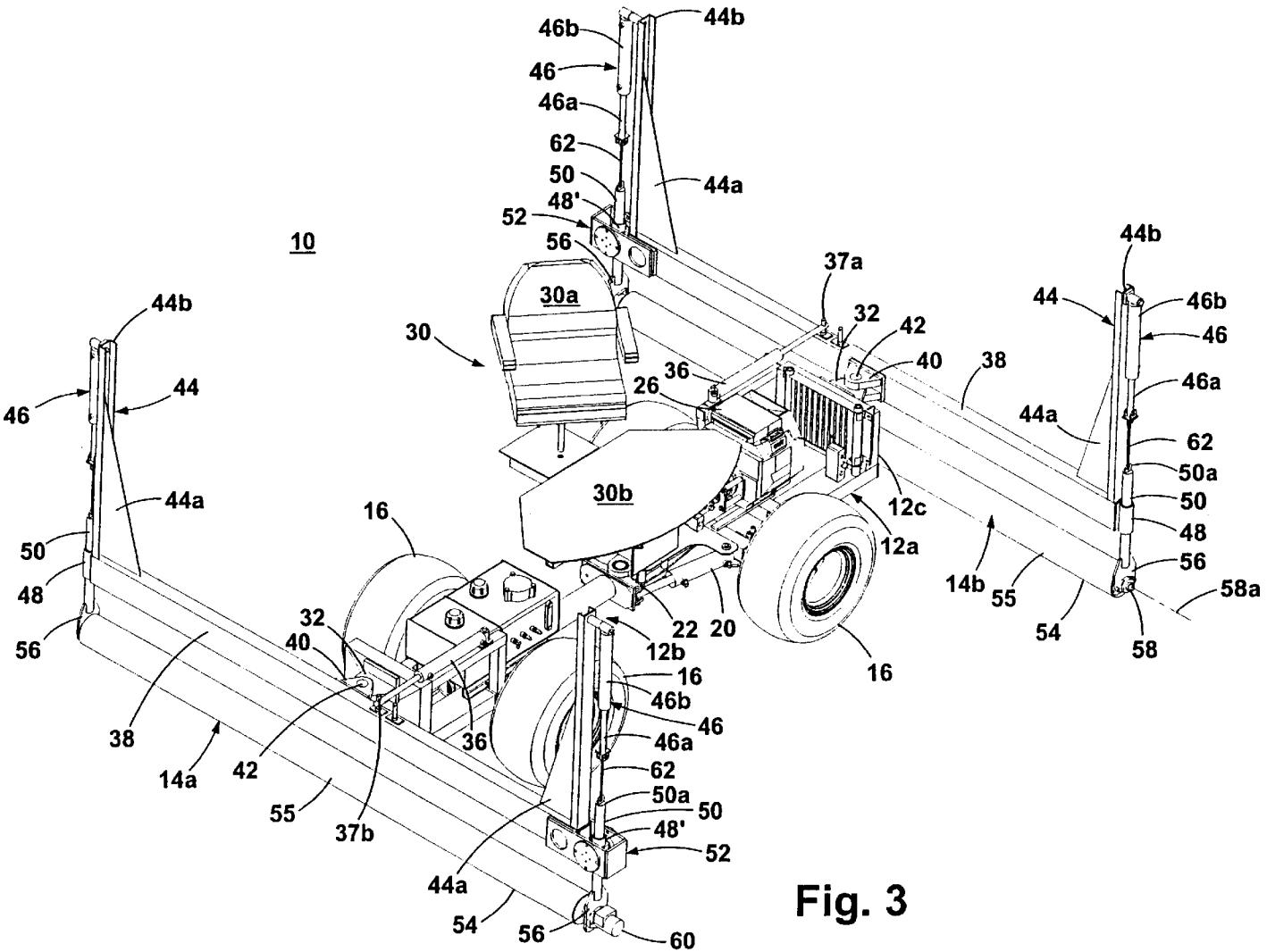
FIG. 3 is another perspective view of the concrete finishing apparatus of FIGS. 1 and 2, with the rotatable finishing members positioned generally normal to the longitudinal axis and direction of motion of the movable unit.

As best shown in FIGS. 1 and 3, a roller support or beam 38 is pivotally mounted to mounts 32 at each end of movable unit 12 via a mounting bracket 40 and a generally vertically oriented connecting pin or axle 42 or the like. Roller support beams 38 are elongated beams extending laterally outward from the generally centrally positioned bracket 40 and function to provide support at either end of the rotatable finishing members 14*a*, 14*b*. Each of the hydraulic cylinders 36 is connected to a respective beam 38 at a position which is laterally offset from bracket 40, such as at one of the mounting positions 37*a* or 37*b*, such that extension and retraction of cylinder 36 causes pivotable movement of beam 38 about a vertical axis 42*a* (FIGS. 2 and 4) defined by pivot pin or axle 42. This allows the orientation of the rotatable finishing members 14*a*, 14*b* to be adjusted relative to the direction of travel of movable unit 12, as discussed below.

Roller support beam 38 further includes a pair of generally vertical supports or brackets 44 extending generally upwardly from opposite ends of beam 38. Each support 44 may further be supported by a gusset 44*a* or the like to limit deflection or lateral movement of support 44. An actuator or hydraulic cylinder 46 is mounted at or near an upper end 44*b* of each support 44 and connected to a respective end of the corresponding rotatable finishing member 14*a*, 14*b*. Each hydraulic cylinder 46 is positioned generally vertically along its respective vertical support 44 and is operable to raise and lower a respective end of rotatable finishing member 14*a*, 14*b* via retraction and extension of the hydraulic cylinder 46.

A generally cylindrical collar or bushing 48 or 48' is mounted at each end of beam 38 and receives and guides a generally cylindrical rod or post 50 of rotatable finishing member 14*a* or 14*b*. Optionally, as shown at one end of the beams 38 in FIGS. 1 and 3, one or both collars 48' at one or both of the ends of each beam 38 may be pivotally mounted to the end of the respective beam 38 via a mounting bracket 52. The mounting bracket 52 pivotally receives collar 48' and allows collar 48' to pivot about a generally horizontal axis 52*a* (FIG. 1) to accommodate any angular orientation of the rotatable finishing member relative to the respective support beam and thus avoid potential binding of rod 50 within collar 48'. Alternately, or additionally, brackets 32 or 40 at movable unit 12 or beam 38, respectively, may provide a U-joint type connection or the like to accommodate such angular orientation, without affecting the scope of the present invention.

Each of the rotatable finishing members 14*a*, 14*b* is an elongated cylinder, or cylindrical tube or roller, having a cylindrical roller portion 55 and a shaft portion or end 58. A longitudinal axis of rotation 58*a* of cylindrical members 14*a*, 14*b* is defined between and along shaft portions 58. The cylindrical roller portion 55 is rotatable about axis 58*a* and defines a smooth generally cylindrical outer contact surface 54 for contacting the partially cured concrete surface and smoothing and leveling the surface to a close-tolerance finish. However, the contact surface of the finishing member may be textured, without affecting the scope of the present invention. The diameter of the cylindrical finishing members may be selected depending on the length of the members and/or on the particular application of the finishing apparatus. For example, the finishing members 14*a*, 14*b* may be selected to be approximately 12 feet in length with a diameter of approximately 12 inches. However, longer or shorter members having larger or smaller diameters may be implemented depending on the particular application, without affecting the scope of the present invention. Each end of the finishing members 14*a*, 14*b* is rotatably mounted to a mounting plate 56 in a suitable bearing or bearing block which receives a shaft end 58 of the member 14*a*, 14*b* therethrough and allows for rotation of the cylindrical roller portion 55 of members 14*a*, 14*b* relative to mounting plate 56 via the bushing or bearing or the like (not shown). The shaft ends 58 may be rotatably received in mounting plates 56 and rotate relative thereto, or the shaft ends may be fixedly mounted to mounting plates 56, whereby the cylindrical roller portion 55 of each finishing member 14*a*, 14*b* is rotatable relative to the respective fixed shaft ends 58, without affecting the scope of the present invention. An hydraulic motor 60 or other means for rotatably driving the finishing member is mounted at one of the mounting plates 56 for each finishing member 14*a*, 14*b* and is operable to drive or rotate the respective rotatable finishing member 14*a*, 14*b* about its respective axis 58*a*, such as via pressurized hydraulic fluid from pump 28 and engine 26 of movable unit 12. Preferably, hydraulic motors 60 are operable in either direction, such that the finishing members may be rotated in either direction, depending on the direction of travel of the movable unit 12. Although shown with generally flat ends, the rotatable finishing members 14 preferably have rounded ends to limit or substantially preclude an edge of the rotatable finishing members from cutting or digging into the partially cured concrete surface, or otherwise leaving a ridge or uneven junction between adjacent passes of the rotatable finishing members.

A cylindrical rod or post 50 extends upwardly from each mounting plate 56 of each end of finishing members 14*a*, 14*b* and is received through the respective collar 48, 48' at the ends of the respective support beam 38. Cylindrical rod 50 is slidably received within collar 48, 48', such that each end of each finishing member 14*a*, 14*b* is vertically adjustable via vertical sliding movement of rods 50 within collars 48, 48'. An upper end 50*a* of each rod 50 is connected to a respective piston rod 46*a* of the respective hydraulic cylinder 46 via a connecting member or linkage 62. Preferably, the linkage 62 is a flexible cable, chain or the like, such that retraction of piston rod 46*a* into cylinder portion 46*b* pulls upward on the vertical rod 50 via linkage 62 to raise the respective end of the respective finishing member upward from the partially cured concrete surface, while the hydraulic cylinder 46 may also lower the rod 50 down to a point where the respective rotatable finishing member rests or is at least partially supported on the partially cured concrete surface, whereby the linkage 62 may have slack to allow the respective rotatable finishing member to substantially rest or "float" on the partially cured concrete surface.

Optionally, the rotatable finishing members 14*a*, 14*b* may be generally hollow and may be filled or partially filled with water or the like to adjust the weight and downward pressure of the members on the partially cured concrete surface when they are lowered to float on the surface. In the illustrated embodiment, the rotatable finishing members have a variable weight of between approximately 100 pounds and approximately 250 pounds. The amount of water added to the rotatable finishing members may be selected depending on the particular application, degree of curing of the partially cured concrete surface, desired result or surface or the like. However, it is further envisioned that hydraulic cylinders 46, or any other raising and lowering devices, may be directly connected to the vertical support rods 50, or may be connected via a solid link or a spring or the like, such that the raising and lowering devices may be operable to directly apply greater or less down pressure at the ends of the rotatable finishing members, in order to effectively adjust the weight or force or down pressure of the rotatable finishing members at the partially cured concrete surface, without affecting the scope of the present invention. The weight or down pressure of the finishing member may be adjusted to a desired amount via extension and retraction of the hydraulic cylinders, depending on the application and degree of cure of the partially cured concrete being processed.

It is further envisioned that the height or vertical position of the finishing member may be adjustable in response to a laser leveling system or control, such as disclosed in U.S. Pat. No. 4,655,633, which is hereby incorporated herein by reference. In such an application, each of the rods or posts 50 may then include a laser receiver 51 (FIG. 1), which may be mounted at upper end 50*a* of vertical support rods 50 or mounted to a rod or mast 51*a* (as shown in phantom in FIG. 1) attached to and along rod 50. The hydraulic cylinders 46 are extendable and retractable to maintain the rotatable finishing member at the appropriate level with respect to a signal from a laser beacon projector (not shown). The laser receivers 51 detect a reference plane generated by the projector, and the controls of finishing apparatus 10 automatically adjust the hydraulic cylinders 46 accordingly, as disclosed in U.S. Pat. No. 4,655,633.

Additionally, the rotational speed of the finishing members may be varied depending on the degree of cure of concrete and the speed of the movable unit, and further depending on the application and characteristics of the concrete being processed and the desired results. For example, the rotational speed of the finishing members may be decreased for softer concrete and increased for harder or more completely cured concrete.

During operation, movable unit 12 is driven directly onto the surface of the partially cured concrete, after the concrete has been allowed to partially set up or cure to a semi-hardened state. The length of time before driving the finishing apparatus onto the partially cured concrete is variable depending on the application, environment, and/or any other given work site conditions which may affect the degree of cure of the concrete over a given period of time. Typically, concrete finishing apparatus 10 would be driven onto the partially cured concrete after the concrete has cured to the point where a first conventional finishing operation, such as a power trowel or the like, would normally begin. The actual cure amount of the concrete prior to smoothing the surface is thus variable and subjective. Optionally, a standardized surface contact pressure test to measure the capacity of the concrete to support the weight of a machine may be performed to determine a preferred amount of setup or cure of the partially cured concrete prior to driving or moving the finishing apparatus 10 onto the partially cured concrete.

As movable unit 12 is driven in a first direction of travel, such as in a forward direction, or generally to the left or in the direction of arrow A in FIG. 1, the rearwardly positioned rotatable finishing member 14*b* is lowered onto the partially cured concrete surface via extension of cylinders 46 until the contact surface 54 of rotatable finishing member 14*b* rests upon the partially cured concrete surface. The finishing member may rest or float upon, or may be pushed downwardly onto, the concrete surface with its axis of rotation 58*a* being generally parallel to the partially cured concrete surface. Hydraulic motor 60 is actuated to rotate finishing member 14*b* about axis 58*a* to cause slippage of the contact surface 54 of rotatable finishing member 14*b* on the partially cured concrete surface, in order to smooth the surface to a highly smooth and flat quality. Preferably, hydraulic motor 60 is operable to rotate finishing member 14*b* in a direction opposite the direction of travel of movable unit 12. In other words, hydraulic motor 60 is preferably operable to rotate finishing member 14*b* in a clockwise direction, when viewed in the direction of arrow AA in FIG. 1, when movable unit 12 is driven in the direction of arrow A. This causes a lower engaging portion of contact surface 54 of rotatable finishing member 14*b* to move or slip relative to the concrete surface in generally the same direction as movable unit 12, or in an opposite direction than it would move if rolling along the partially cured concrete surface.

The slippage of finishing member 14*b* over the partially cured concrete surface causes a thin layer of cement paste to be removed by finishing member 14*b*. Because the direction of rotation is preferably opposite to the direction of travel, the cement paste is carried forwardly by the rotating finishing member 14*b* as the movable unit 12 is moved across the concrete surface. Also, because the cement paste is skimmed off the surface of the concrete and moved along by the rotatable finishing member, when the finishing member reaches a depression or an area below grade, some of the excess concrete paste will be deposited in the lower areas to enhance the level and flatness of the floor. The process of removing the excess cement paste from any high areas or other imperfections and depositing the cement paste in the lower areas results in a highly flat and level floor quality for the concrete surface.

Preferably, finishing apparatus 10 further includes a roller scraper 57 positioned along each rotatable finishing member 14*a*, 14*b* (FIG. 2). Roller scraper 57 engages the contact surface 54 of the respective rotatable finishing member 14*a*, 14*b* to scrape or wipe any concrete residue or cream from the contact surface 54 which may accumulate on the contact surface 54 as the rotatable finishing member 14*a*, 14*b* rotates and engages the partially cured concrete surface. The roller scraper 57 thus maintains a substantially clean and smooth surface of the rotatable finishing members 14*a*, 14*b*. Preferably, roller scraper 57 is positioned along the forward side (toward the movable support) of the rotatable finishing member to scrape the residue from the finishing member such that any excess concrete or residue will fall from roller scraper down onto the partially cured concrete surface in front of the finishing member. Roller scraper 57 may include a flexible rubber or plastic type lip or may include a generally rigid, metal or plastic lip for engaging and scraping the excess material from the contact surface of the respective rotatable finishing member.

As best seen in FIGS. 1, 3 and 5, rotatable finishing members 14*a* and 14*b* may be pivoted about their pivot axles 42 via a respective hydraulic cylinder 36, such that they are angled and skewed relative to the direction of travel of movable unit 12 to provide a windrow effect as the finishing apparatus is moved along the concrete surface. This allows the finishing members to skim the cement paste and effectively carry it along with the movable unit 12 and rotatable finishing members 14*a*, 14*b*, should any of the cement paste from the first finishing member accumulate and then be deposited along the forwardly positioned end of the second finishing member, such as end 14*c* of finishing member 14*b*. The cement paste will then be carried to end 14*d* of finishing member 14*b* and released when the movable unit 12 is moved in the direction A in FIG. 1. As the cement paste accumulates in front of the rotatable finishing members 14*a*, 14*b*, and movable unit 12 is moved in the direction of arrow A in FIG. 1, the excess cement paste will migrate laterally toward the rearwardly positioned end of each respective finishing member, such as toward the end 14*d* of rotatable finishing member 14*b* and end 14*e* of rotatable finishing member 14*a* in FIG. 1. Concrete finishing apparatus 10 may be repeatedly driven back and forth over laterally adjacent sections or passes of the partially cured concrete slab, with the rotatable finishing member or members being skewed or canted, such that any cement paste removed by the rotatable finishing member is deposited on a particular side of the respective pass of the smoothing and finishing apparatus. Thus, upon completion of the multiple passes over the partially cured concrete slab, the entire surface is substantially flat, level and smooth, with minimal or no deposits of accumulated cement paste present thereon. The rounded ends of the rotatable finishing members 14*a* and 14*b* limit or substantially preclude any cuts or ridges at the lateral end of the pass which partially overlaps a surface area already smoothed and leveled by an earlier pass.

Optionally, as shown in FIG. 5, the finishing apparatus 10 may include a retractable cream scoop or plow-type device 90 and cream guide wings 92 which function to control, move, or otherwise transport any excess concrete material off and away from the worked surface of the concrete. These devices can also be utilized to smear and/or evenly redistribute any excess material back into the surface of the concrete over a large area, thus minimizing the effect that the excess material may have on the quality of the finished surface.

Accordingly, as finishing apparatus 10 is driven over the partially cured concrete, the finishing members, cylinders or rollers 14*a*, 14*b* spin against the partially cured concrete surface to smooth the concrete to a high quality finish. The speed of rotation of the finishing members may be variable and may be increased or decreased depending on the immediate conditions as determined by the operator, degree of cure of the concrete and/or speed of travel of the movable unit 12. For example, the rotational speed of the finishing members may be increased for harder, more completely cured concrete, and decreased for softer, less cured concrete. Preferably, the finishing members are rotated at a speed of approximately 400 rpm, but may be rotated at other speeds, as long as the surface of the rotatable finishing member is movable relative to the concrete surface in order to cause sufficient slippage of the contact surface of the finishing member against the surface and working of the material at the region of surface contact to effectively remove and redistribute a thin layer of cement paste at the surface. Additionally, as discussed above, the weight of the finishing members or down pressure of the finishing members may be varied depending on the application and degree of cure of the partially cured concrete slab.

Therefore, concrete finishing apparatus 10 is drivable over and supported on the partially cured concrete and operable to finish the concrete to a highly smooth, flat and level finish. Preferably, as the vehicle is driven in either direction, only the rotatable finishing member positioned rearwardly with respect to the direction of travel is lowered and rotated to finish the surface of the concrete. However, optionally, the forward positioned finishing member may also be lowered to the concrete surface to provide a first finishing process to the partially cured concrete surface, whereby the rearwardly positioned finishing member then provides a final finishing process to fill in any depressions or imprints which may have been left by the wheels 16 of movable unit 12.

Figure 6:
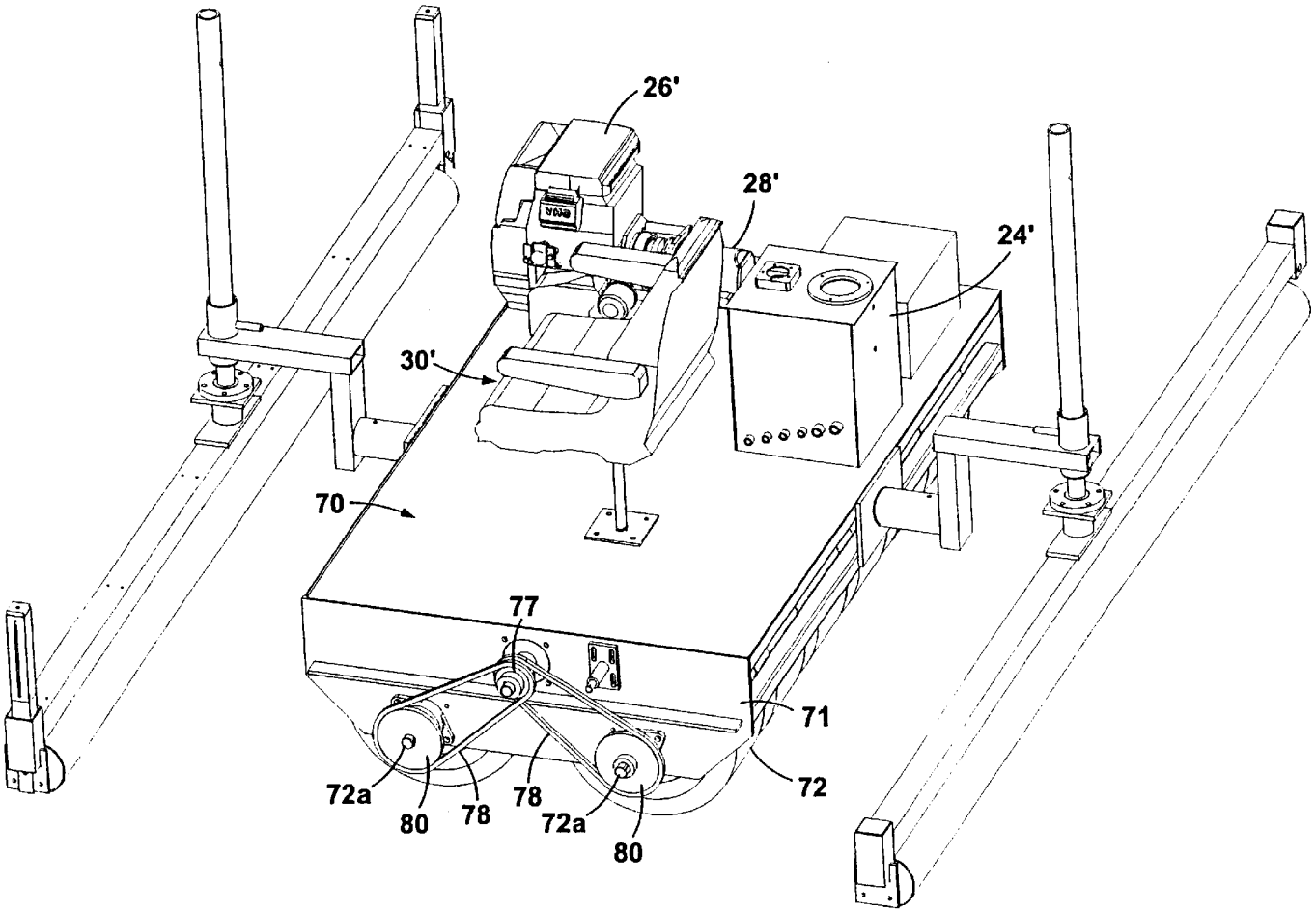
FIG. 6 is an upper perspective view of a wheeled base unit useful with the present invention.
Figure 7:
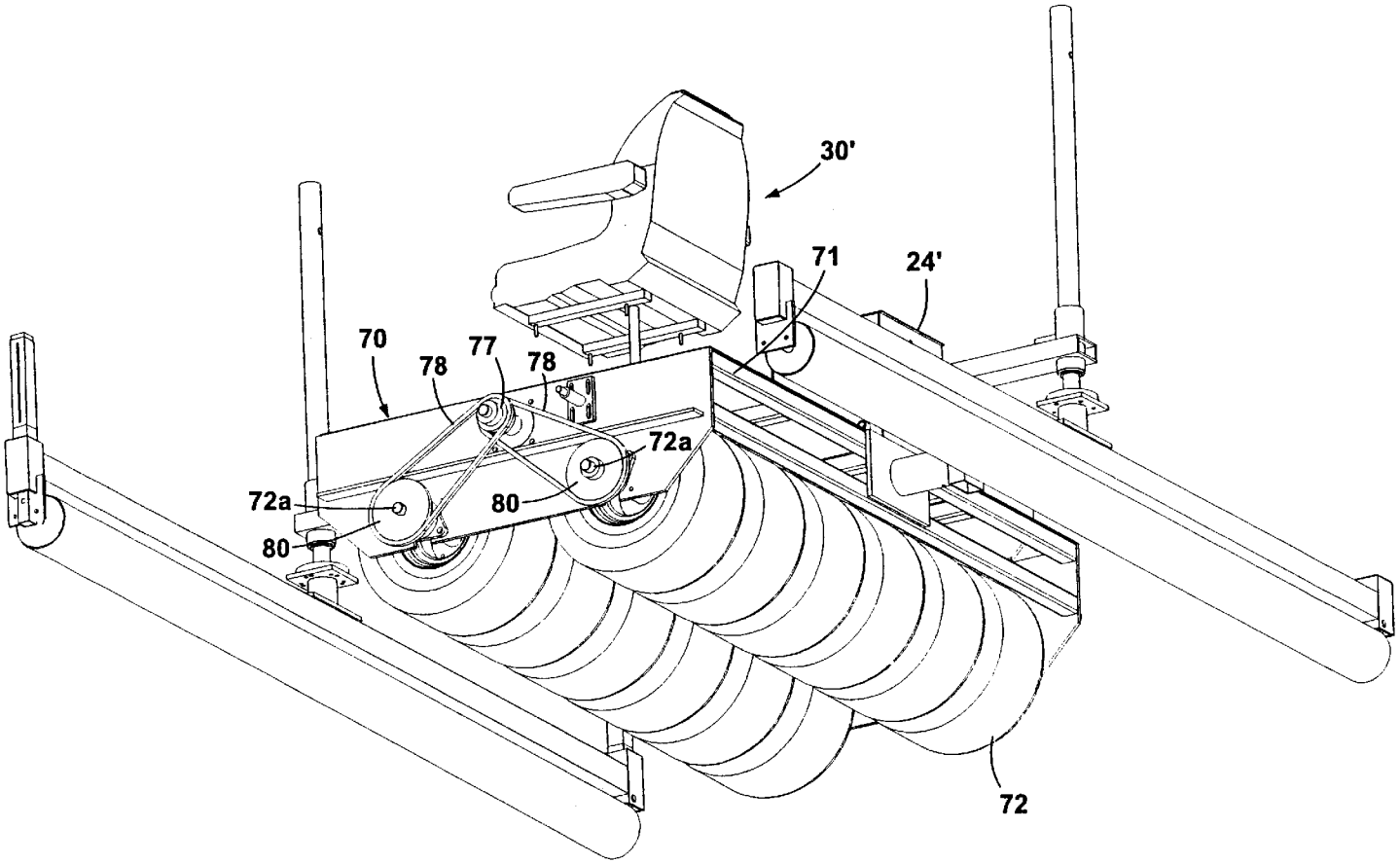
FIG. 7 is a lower perspective view of the wheeled base unit of FIG. 6.
Figure 8:
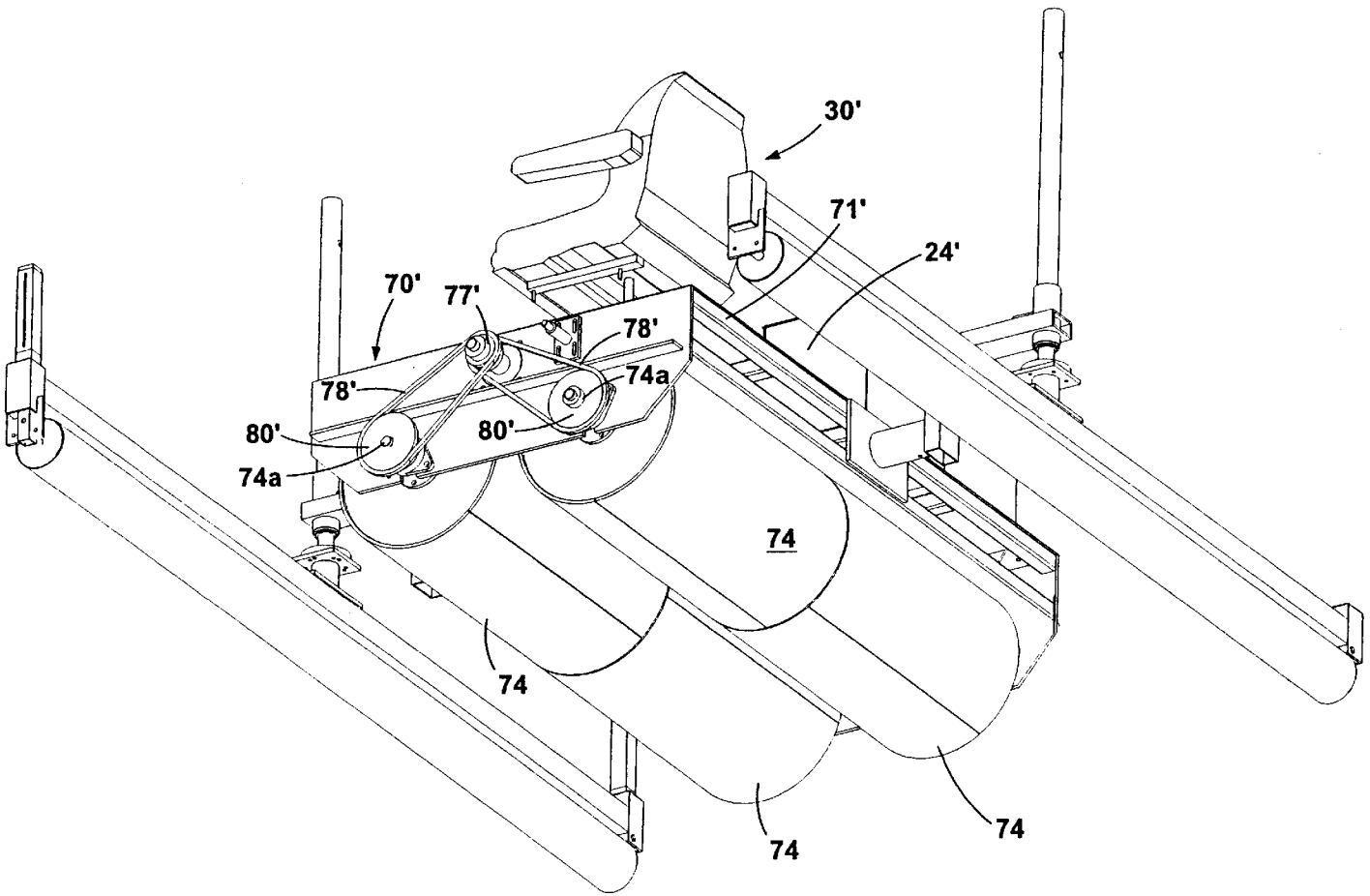
FIG. 8 is a lower perspective view of a roller base unit useful with the present invention.

As shown generally in FIGS. 6–8, the movable unit of the present invention may be mounted on various platforms 70, 70' which include rotatable and/or drivable tires 72 (FIGS. 6 and 7) or rollers 74 (FIG. 8) for driving and supporting the movable unit over the partially cured concrete surface. As shown in FIGS. 6 and 7, multiple wide profile, generally smooth tires 72 (such as the twelve tires in the illustrated embodiment) may be driven via a pair of hydraulic motors or other drive means (not shown) and drive pulleys 77, which are operable to drive the tires on a respective side of a frame 71 via one or more drive belts 78 or the like and pulleys 80 at the axles 72*a* of the tires 72. However, other drive means may be implemented without affecting the scope of the present invention. The movable unit or vehicle may then be steered or turned by driving the sets of tires at opposite sides of the frame 70 at different speeds, or driving a set of tires on one side of frame 70 in one direction, while driving the set of tires on the other side of frame 70 in the opposite direction.

As shown in FIG. 8, platform 70' may be similarly driven via a pair of hydraulic motors or other drive means (not shown) and drive pulleys 77' and belts 78' and pulleys 80' at axles 74*a* to rotate the wide rollers 74 at each side of a frame 71' in either direction to drive and turn platform 70' and the movable unit over a partially cured concrete surface. Preferably, the tires and/or rollers for the movable unit of the present invention have a substantially smooth contacting surface, in order to minimize any imprints or depressions in the partially cured concrete surface as the movable unit is driven and/or steered over the partially cured concrete surface. The platforms 70, 70' may further include an operator station 30' and engine 26', reservoir 24' and pump 28' for hydraulically driving the hydraulic motors and hydraulic cylinders associated with the platform and finishing members, similar to movable unit 12, discussed above. Also, one or more rotatable finishing members is/are preferably mounted at either or both ends of the platforms 70, 70' in a similar manner as discussed above with respect to movable unit 12 of finishing apparatus 10.

Figure 9:
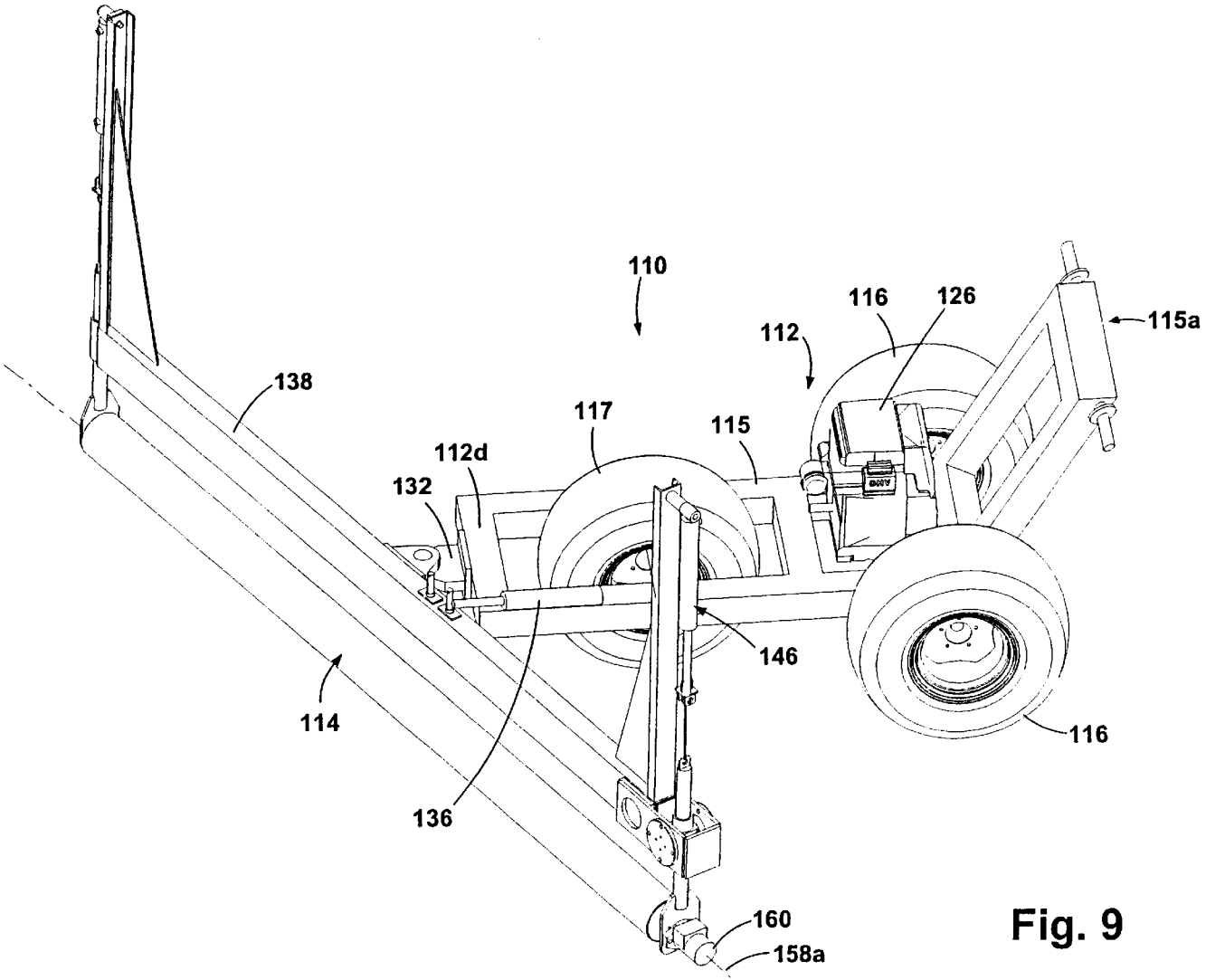
FIG. 9 is a perspective view of a three-wheeled concrete finishing apparatus having a single rotatable finishing member in accordance with the present invention.
Figure 10:
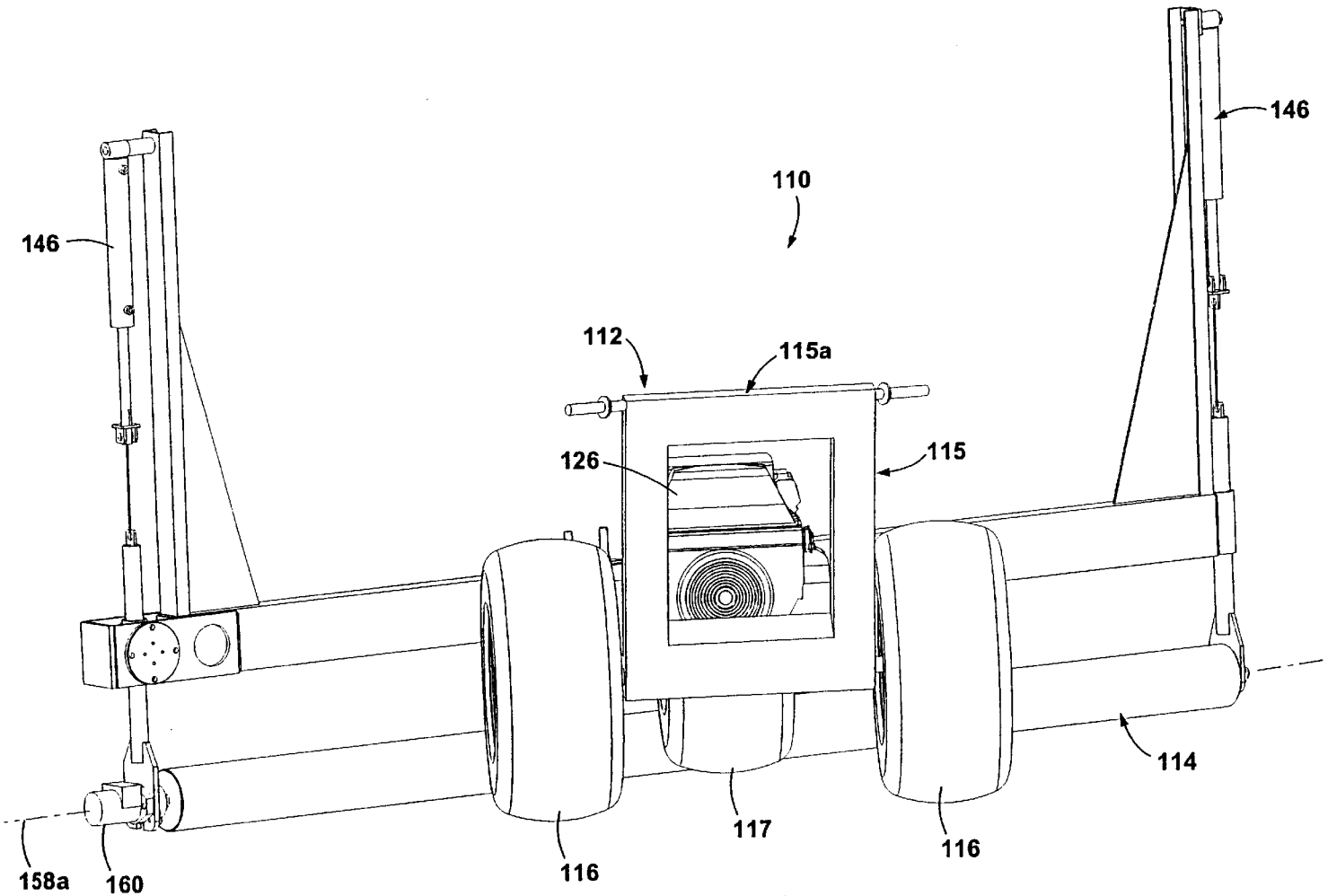
FIG. 10 is a rear perspective view of the three-wheeled concrete finishing apparatus of FIG. 9.

Referring now to FIGS. 9 and 10, an alternate embodiment of a concrete finishing apparatus 110 in accordance with the present invention includes a three-wheeled movable unit 112 which is movable over and supported on a partially cured concrete surface, similar to movable unit 12, discussed above. Movable unit 112 includes an engine 126, hydraulic system and reservoir (not shown) and pump (also not shown), where the hydraulic pump is operable to provide pressurized fluid to the various hydraulic motors and cylinders of concrete finishing apparatus 110, similar to concrete finishing apparatus 10, discussed above.

Movable unit 112 includes a bracket 132 positioned at its rearward end 112*d* for pivotally mounting a support beam 138 and a rotatable finishing member 114 to movable unit 112 about a generally vertical axis. Support beam 138 and rotatable finishing member 114 are substantially similar to support beam 38 and rotatable finishing member 14*a*, 14*b*, discussed above, such that a detailed description will not be repeated herein. Suffice it to say that, as movable unit 112 is moved along the concrete surface, such as rearwardly or to the right in FIG. 9, rotatable finishing member 114 is lowered via hydraulic cylinders 146 and rotated about its longitudinal axis 158*a* via hydraulic motor 160 to smooth and finish the concrete surface to a close-tolerance finish. Preferably, hydraulic motor 160 is operable to rotate finishing member 114 in a direction generally opposite the direction of travel of movable unit 112, similar to concrete finishing apparatus 10. An hydraulic cylinder 136 is operable to adjust the angle of the beam 138 and finishing member 114 with respect to the direction of travel of the movable unit 112 via pivotal movement of beam 138 about bracket 132, so as to provide a windrow ability, as discussed above with respect to finishing apparatus 10.

Movable unit 112 includes a pair of smooth inflatable tires 116 and a single, center inflatable tire 117, which are mounted to a frame 115. Preferably, tires 116 are driven via hydraulic motors or other drive means (not shown), while center tire 117 is freely rotatable relative to frame 115. Movable unit 112 may be guided or pulled along the concrete surface by an operator via a set of handles and controls 115*a* at one end of movable unit 112. Movable unit 112 may be steered via a change in the driven rotational speed or direction of one of the wheels 116 relative to the other wheel 116, or may be manually pivoted via lifting of the center tire 117 by effectively balancing the machine on wheels 116 and turning the unit 112 by the operator, in order to change the direction of movable unit 112. Concrete finishing apparatus 110 may be preferred for smaller sized concrete surfaces, due to its additionally compact size and maneuverability.

Optionally, the movable unit of the concrete leveling apparatus of the present invention may include only a single tire or a pair of generally coaxial tires, such that the rearward weight of the movable unit and the rotatable finishing member is supported by the rotatable finishing member on the partially cured concrete surface. The movable unit may be manually pulled or moved over the partially cured concrete surface or may be driven via drive means for driving one or more of the tires of the movable unit. The movable unit may be balanced or weighted such that the rotatable finishing member may be substantially supported on the partially cured concrete surface, or such that a desired amount of force or down pressure is applied by the rotatable finishing member to the partially cured concrete surface. The movable unit may include a counterweight mechanism to provide for an adjustment of the force applied to the concrete surface by the rotatable finishing member. For example, the movable unit may include removable weights at either end of the movable unit, such that adding or removing the weights adjusts the degree of support of the rotatable finishing member on the partially cured concrete surface. Optionally, the movable unit may include a sliding weight, which may be moved along the movable unit to increase or decrease the force or down pressure exerted by the rotatable finishing member on the partially cured concrete surface.

Figure 11:
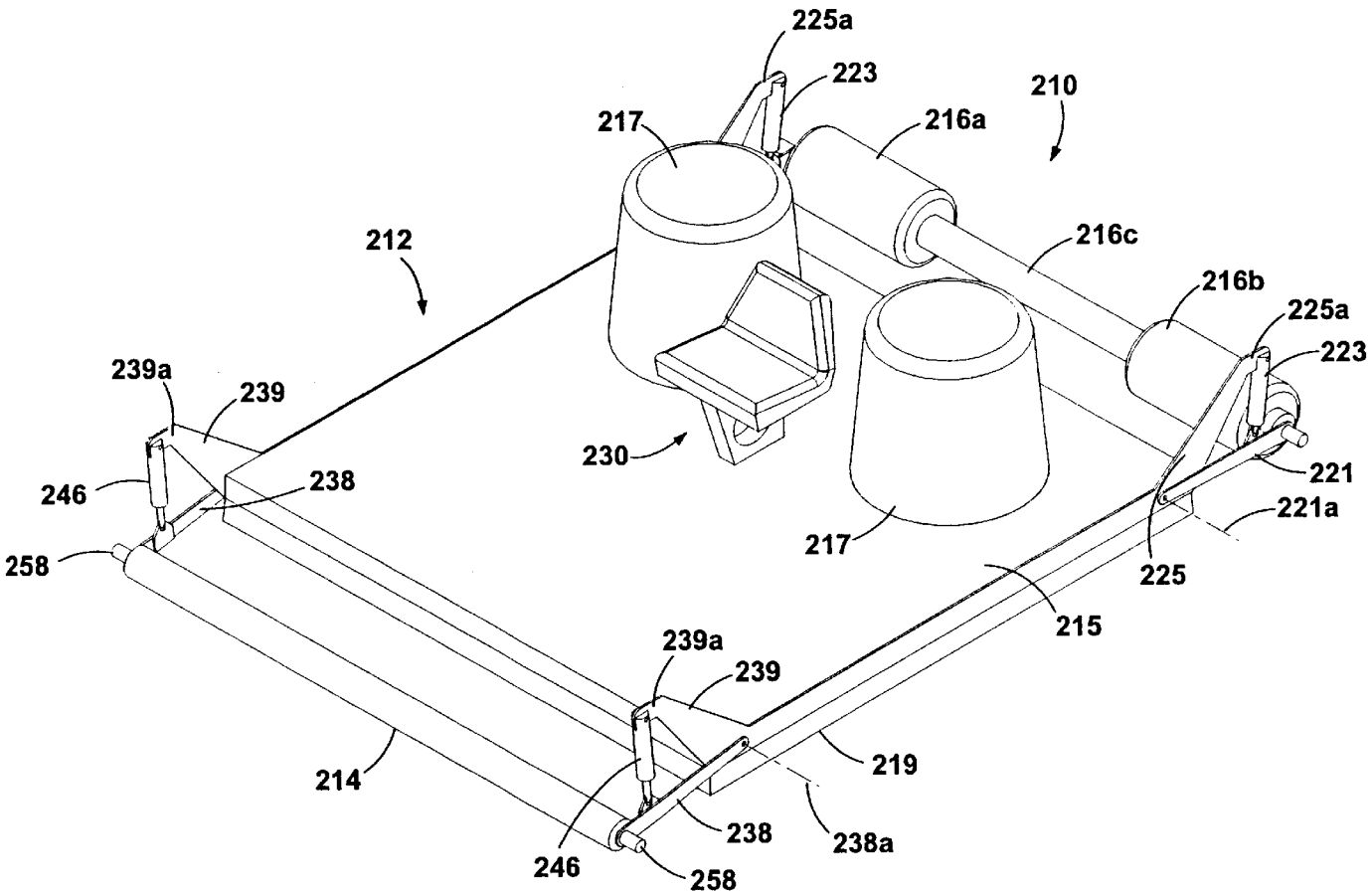
FIG. 11 is a perspective view of an alternate embodiment of a concrete finishing apparatus in accordance with the present invention having an air cushion movable unit.
Figure 12:
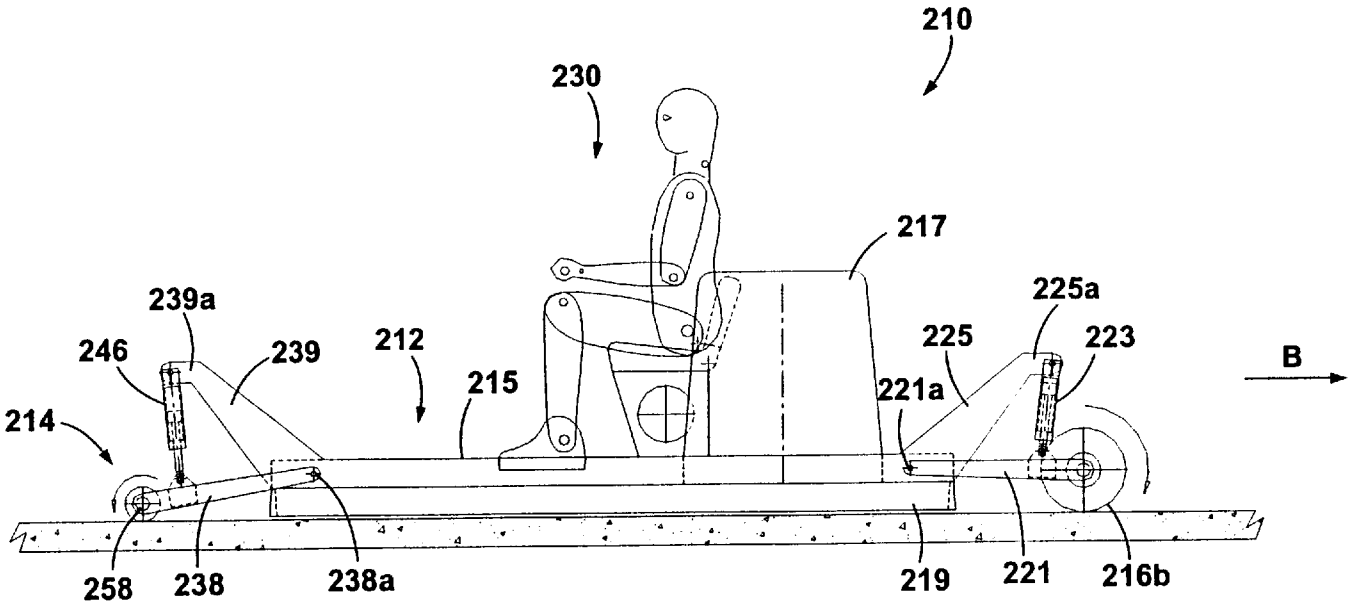
FIG. 12 is a side elevation of the concrete finishing apparatus of FIG. 11.

Referring now to FIGS. 11 and 12, another alternate embodiment of a concrete finishing apparatus 210 in accordance with the present invention includes an air cushion movable support or unit 212 and a rotatable finishing member 214. Air cushion movable support 212 includes a platform 215 and a pair of lift fans 217, which are operable to raise movable support 212 above the partially cured concrete support surface via a cushion of air generated by fans 217 and partially sealed between the air cushion support 212 and the concrete surface via a brush skirt or other sealing device or structure 219 positioned along a circumferential lower rim or edge of platform 215. Preferably, the air cushion movable support 212 is similar to the air cushion support units disclosed in commonly assigned U.S. patent application Ser. No. 09/738,617, filed Dec. 15, 2000, now U.S. Pat. No. 6,623,208 (Attorney Docket SOM01 P-310); and International Publication No. WO 01/43932 A1, published Jun. 21, 2001, which are hereby incorporated herein by reference.

Air cushion movable unit 212 may further include a seat and machine controls area 230 for an operator to ride on and control the movable unit 212. However, similar to finishing apparatus 10, concrete finishing apparatus 210 may optionally be remotely driven by an operator remote from the movable unit 212 via a remote control radio or electrical signal device or the like, or may be programmable to move over the partially cured concrete surface in a preprogrammed automatic manner, without affecting the scope of the present invention.

Air cushion movable unit 212 is driven over the partially cured concrete via one or more rotatable rollers 216*a*, 216*b* which are rotatably driven via hydraulic motors or other drive means (not shown) to move and steer the air cushion movable support 212 over the partially cured concrete surface. In the illustrated embodiment, a pair of substantially smooth rollers 216*a*, 216*b* are separated by shaft portion 216*c*, such that each roller is positioned at or toward opposite sides of the movable unit 212. Accordingly, movable unit 212 may be driven and moved along the concrete surface via rotation of both rollers 216*a*, 216*b*, while steering may be performed by rotating one of the rollers at a different speed from the other roller, or rotating one of the rollers in one direction, while rotating the other roller in an opposite direction, to pivot or turn the movable unit 212.

Rollers 216*a*, 216*b* may be mounted to movable unit 212 via a pivotable mounting arm 221, which is pivotably mounted to frame 215 and is pivotable about a generally horizontal axis 221*a*. Mounting arm 221 pivots about axis 221*a* to raise and lower rollers 216*a*, 216*b*, in order to provide an appropriate amount of down pressure on the partially cured concrete surface by the rollers, depending on the amount of lift provided by the air cushion support 212 above the concrete surface, and the degree of cure of the concrete. An hydraulic cylinder 223 is mounted between an outer end 225*a* of a mounting bracket 225 at each side of the movable unit 212 and pivotable arm 221. Hydraulic cylinder 223 is operable to extend and retract in order to lower and raise the outer end of the pivotable linkage or mounting arm 221 relative to bracket 225 and frame 215, and thus to adjust the position and/or down pressure and tractive effort of the rollers 216*a*, 216*b* on the partially cured concrete surface.

Rotatable finishing member 214 is similarly mounted at an opposite end of the movable unit 212 from the end on which rollers 216*a*, 216*b* are mounted. More particularly, rotatable finishing member 214 is rotatably mounted to a pair of pivotable mounting arms or members 238, which are pivotally mounted to each side of frame 215 and are pivotable about a generally horizontal axis 238*a* relative to the frame or platform 215 of movable unit 212. A shaft end 258 of finishing member 214 is received at an outer end of each pivotable arm 238, such that finishing member 214 is rotatably driven relative to pivotable arms 238 via an hydraulic motor or the like (not shown). An actuator or hydraulic cylinder 246 is mounted between an outer end 239*a* of a mounting bracket 239 and pivotable arm 238 at each side of the movable unit 212 and is extendable and retractable to adjust a position and/or down pressure of rotatable finishing member 214 on the partially cured concrete surface via pivotal movement of mounting arms 238 relative to frame 215.

As shown in FIG. 12, movable unit 212 is preferably driven in a direction B or to the right in FIG. 12, via clockwise rotation of rollers 216*a*, 216*b*, such that finishing member 214 is pulled along at a rearward end of movable unit 212. As movable unit 212 is moved over the partially cured concrete surface, finishing member 214 is rotated in a direction generally opposite the direction of travel of the movable unit 212, or in other words, in a counter clockwise direction as shown in FIG. 12. The oppositely rotating finishing member 214 is then operable to smooth and level the concrete surface to a close-tolerance quality finish, similar to the rotatable finishing members discussed above with respect to concrete finishing apparatus 10, 110.

Figure 13:
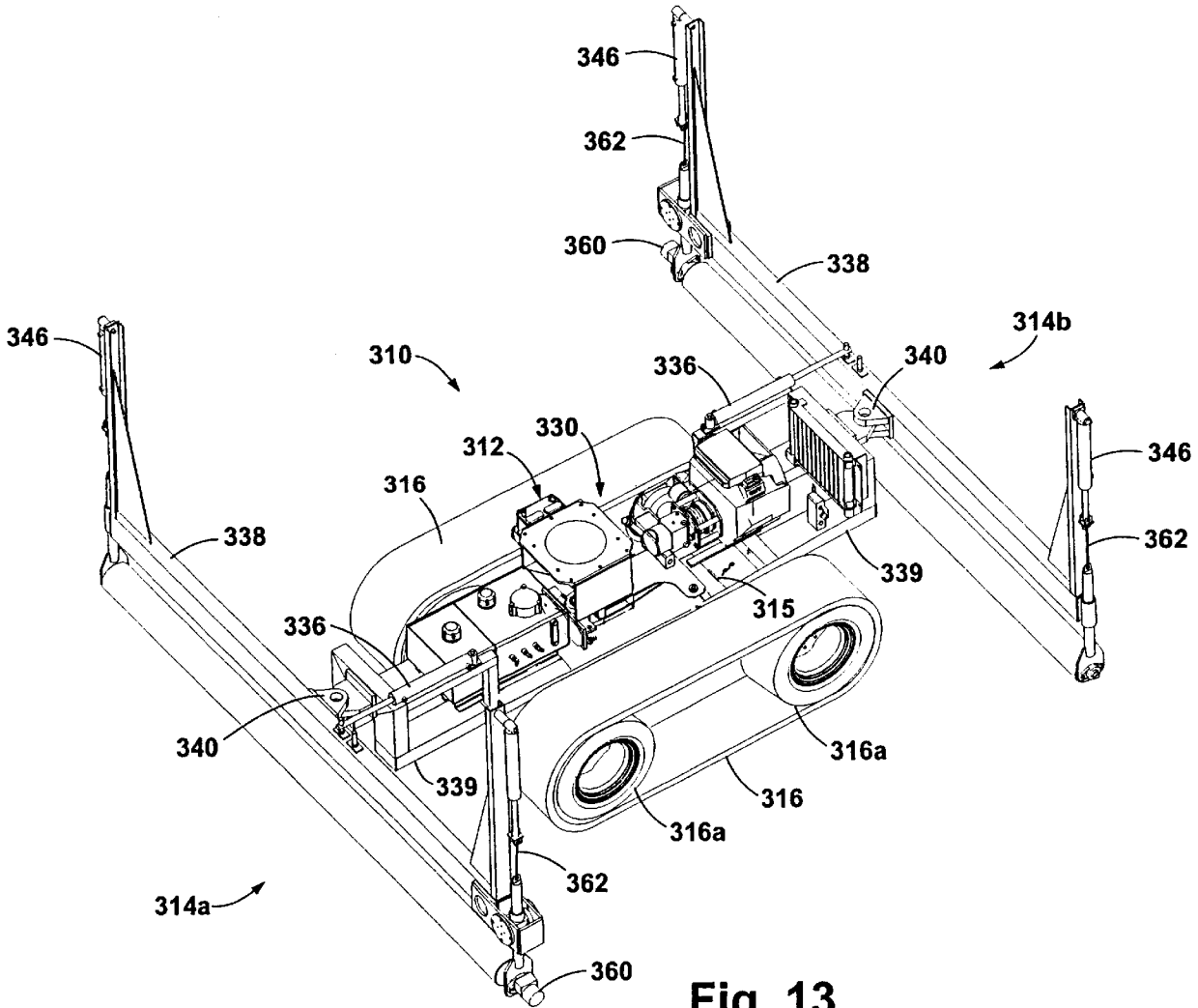
FIG. 13 is a perspective view of another alternate embodiment of a concrete finishing apparatus in accordance with the present invention having a movable unit supported and movable by a pair of continuous tracks at either side of the movable unit.

Referring now to FIG. 13, yet another embodiment of a concrete finishing apparatus 310 in accordance with the present invention includes one or more rotatable finishing members 314*a* and/or 314*b* and a track driven movable unit 312. The rotatable finishing members 314*a*, 314*b* and respective support beams 338 are substantially similar to the rotatable finishing members 14 and support beams 38 discussed above with respect to concrete finishing apparatus 10, such that a detailed description of their structures and functions will not be repeated herein. Suffice it to say that each of the support beams 338 is preferably pivotally mounted to a support member or bracket 340 and pivotable about a generally vertical axis via extension and retraction of an hydraulic cylinder 336. Each bracket 340 and cylinder 336 is preferably mounted at an outer end of a second support beam or structure 339 extending outwardly from a respective one of a front or rear portion of movable unit 312. Rotatable finishing members 314*a*, 314*b* are supported at opposite ends of the beams 338 by support linkages 362 and are vertically adjustable via hydraulic cylinders 346 and rotatably driven via an hydraulic motor 360 or any other drive means, in a similar manner as rotatable finishing members 14*a*, 14*b*, discussed above.

Movable unit 312 includes a pair of movable, continuous tracks 316 at opposite sides of movable unit 312. Each of the tracks 316 are driven via a pair of rollers 316*a* at opposite ends the movable unit 312. Movable unit 312 further includes a platform or frame 315 positioned between and/or over the continuous tracks 316. Platform 315 may further include an operator station 330 and a seat or chair (not shown) for an operator to sit at and control concrete finishing apparatus 310. Optionally, movable unit 312 may be operable via remote control or via a programmable control, without affecting the scope of the present invention.

The continuous tracks 316 are preferably substantially smooth tracks and may be driven in either direction, and function to spread out the weight of concrete finishing apparatus 310 over a large area of the partially cured concrete surface, thereby minimizing any depressions in the partially cured concrete as movable unit 312 is driven thereacross. Similar to movable unit 212, discussed above, movable unit 312 may be steered by driving one of the tracks at a different speed from the other track, or by driving one of the tracks in one direction while driving the other track in the opposite direction, to cause pivotal and turning movement of the movable unit 312 over the partially cured concrete surface.

Figure 14:
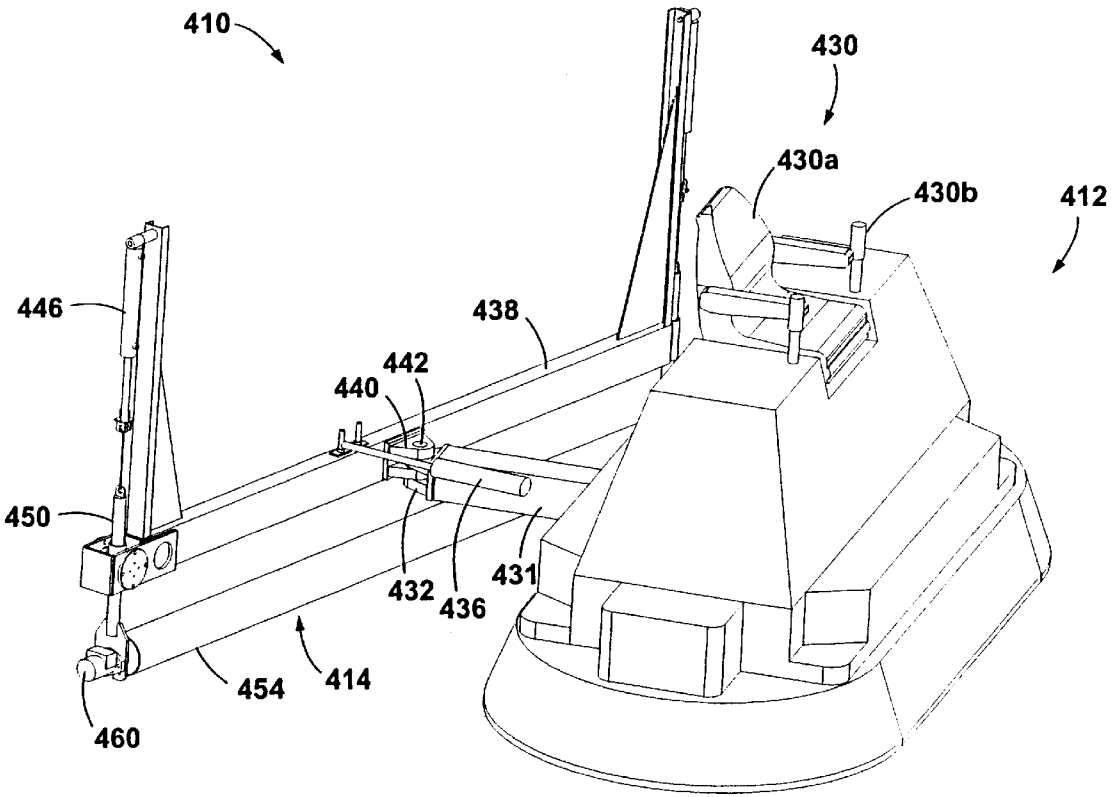
FIG. 14 is a perspective view of another alternate embodiment of a concrete finishing apparatus in accordance with the present invention having a rotatable finishing member mounted to a rearward end of a power trowel.

Referring now to FIG. 14, a concrete finishing apparatus 410 in accordance with the present invention includes a movable support or unit 412 and a rotatable finishing member 414 mounted at a rearward end of movable unit 412. Similar to the concrete finishing apparatus embodiments discussed above, concrete finishing apparatus 410 is operable to move over and along a surface of a partially cured concrete slab or deck and to finish the partially cured concrete surface to a substantially flat, smooth and level finished surface via spinning engagement of the finishing member 414 with the partially cured concrete surface.

Movable unit 412 is a ride-on power trowel device, such as a conventional power trowel well known in the construction industry, such as, for example, a riding trowel of the type commercially available from Allen Engineering Corporation of Paragould, Ark. Power trowel 412 includes an operator station 430, which includes a seat 430*a* and controls 430*b* for an operator to control the movement of power trowel 412 from the operator seat 430*a*. Power trowel 412 also includes a rearward extending mounting beam 431 and a roller mounting bracket 432 at a rearward end of mounting beam 431. Mounting bracket 432 pivotally receives or pivotally connects to a mounting bracket 440 of a support beam 438. Mounting brackets 432, 440 and beam 438 are substantially similar to the respective brackets 32, 40 and beam 38 discussed above with respect to finishing apparatus 10, such that a detailed discussion of these components will not be repeated herein.

Also similar to rotatable finishing member 14 of finishing apparatus 10, rotatable finishing member 414 is mounted to support beam 438 via a pair of rods or cylindrical members 450, which are vertically adjustable relative to support beam 438 in response to a corresponding actuator or hydraulic cylinder 446. The cylinders 446 are operable to vertically adjust the level of the finishing member 414 and may function to adjust an amount of down pressure applied by the finishing member to the partially cured concrete surface, as discussed above. Preferably, finishing apparatus 410 includes an actuator or hydraulic cylinder 436 which is operable to extend and retract to pivot the support beam 438 and finishing member 414 about a pivot pin or axle 442 at mounting brackets 432, 440, such that the angle of finishing member 414 may be adjusted with respect to the direction of travel of power trowel 412 as finishing apparatus 410 is moved over and along the partially cured concrete surface. The other components of the finishing member and support beam of finishing apparatus 410 are substantially similar to the components of finishing apparatus 10, discussed above, such that a detailed discussion of these components will not be repeated herein.

As discussed above with respect to finishing apparatus 10, finishing member 414 is operable, such as in response to an hydraulic motor 460 or other drive means, to rotatably engage the partially cured concrete surface while power trowel 412 is moved in a forward direction. Preferably, the direction of rotation of finishing member 414 is generally opposite the direction of travel of the power trowel, such that a contact surface 454 of the finishing member 414 slips in a generally opposite direction along the partially cured concrete surface as the finishing apparatus is moved therealong.

Therefore, the present invention provides a concrete finishing apparatus which is operable to provide a highly flat and level floor surface quality with minimal manual labor processes. The concrete finishing apparatus of the present invention is placed in operation directly on or over the concrete surface after the concrete has reach a specified degree of cure or when the concrete floor is partially set up. The entire machine is driven over the surface of the concrete with its rollers, high floatation tires, tracks, or air cushion support, or any other support means, supporting the entire weight of the machine directly on the partially cured concrete. Accordingly, no preset forms or rails are required for the present invention.

The concrete finishing apparatus of the present invention is operable to smooth and level partially cured concrete which has cured to a point where a typical or conventional power troweling process may commence. The finishing apparatus of the present invention processes the concrete surface to achieve results similar to a highway straight edge and a power trowel combined, such that such processes may no longer be necessary. This greatly reduces the number of operators required to achieve a high quality surface finish to the concrete slab.

Because the concrete finishing apparatus and method of the present invention does not require the conventional manual processes, a more consistent and improved flat and level floor quality may be achieved by the present invention. Additionally, the apparatus and method of the present invention can smooth out dips or bumps, which may have been formed in the floor during the screeding processes. Because the concrete finishing apparatus of the present invention is operable over partially cured concrete surfaces, any dips or bumps formed during the screeding processes may be filled in or removed by the apparatus of the present invention without causing additional dips or defects to the concrete surface.

Because the rotatable finishing member of the present invention is preferably adjustable to be canted, angled or skewed with respect to the direction of travel of the movable support, any accumulation of residue or cement paste deposited by the finishing member will be kept along one end of the finishing member, thereby requiring less cleanup later and thus resulting in an improved quality finish of the concrete surface.

The concrete finishing apparatus of the present invention is thus capable of finishing and flattening and leveling the floor in a single process. The single process requires minimal manual labor and provides more consistent and improved results over conventional manual processes. The reduction in manual labor, process cycle time, and improvement in floor quality result in lower production costs and superior super-flat floors.

Changes and modifications in the specifically described embodiments can be carried out without departing from the principles of the invention, which is intended to be limited only by the scope of the appended claims as interpreted according to the principles of patent law.

The embodiments of the invention in which an exclusive property or privilege is claimed are defined as follows:

1. A concrete finishing apparatus for smoothing and leveling partially cured concrete at a support surface comprises:

a movable unit which is movable and supported over and/or on the partially cured concrete and is movable in at least a first direction, said movable unit being supported on the partially cured concrete by at least one support engaging a surface of the partially cured concrete; and at least one rotatable finishing member mounted at said movable unit, said at least having a longitudinal axis, said cylindrical member being rotatable about said longitudinal axis, said cylindrical member defining a cylindrical contact surface therealong which is adapted to contact the surface of the partially cured concrete as said rotatable finishing member is rotated over the partially cured concrete, said cylindrical member being rotatable such that said contact surface moves relative to the surface of the partially cured concrete as said movable unit and said at least one rotatable finishing member are moved over the partially cured concrete.

2. The concrete finishing apparatus of claim 1, wherein said rotatable finishing member is positioned behind said movable unit as said movable unit moves in said first direction.

3. The concrete finishing apparatus of claim 2, wherein said rotatable finishing member is rotatable in an opposite direction from said first direction such that said contact surface is movable relative to the partially cured concrete surface in said first direction as said movable unit moves in said first direction.

4. The concrete finishing apparatus of claim 1, wherein said rotatable finishing member is vertically adjustable relative to said movable unit.

5. The concrete finishing apparatus of claim 4 including a laser leveling system, said rotatable finishing member being vertically adjustable in response to said laser leveling system.

6. The concrete finishing apparatus of claim 1, wherein said rotatable finishing member is variably weighted to adjust or vary an amount of force or downward pressure being applied to the partially cured concrete by said rotatable finishing member.

7. The concrete finishing apparatus of claim 1, wherein said at least one support spreads the weight of said movable unit over an area of the partially cured concrete to limit depression of the partially cured concrete by said movable unit.

8. The concrete finishing apparatus of claim 7, wherein said at least one support comprises at least one tire.

9. The concrete finishing apparatus of claim 8, wherein said movable unit is adjustably weighted to adjust an amount of down pressure of said rotatable finishing member on the partially cured concrete surface.

10. The concrete finishing apparatus of claim 7, wherein said at least one support comprises at least four inflatable tires.

11. The concrete finishing apparatus of claim 7, wherein said at least one support comprises at least two elongated rollers which are rotatable to move said movable unit over the concrete surface.

12. The concrete finishing apparatus of claim 7, wherein said at least one support comprises at least two continuous tacks.

13. The concrete finishing apparatus of claim 1, wherein said movable unit comprises an air cushion unit which is operable to generate a cushion of air beneath said air cushion unit, said at least one support comprising said cushion of air generally between said movable unit and the surface of the uncured concrete.

14. The concrete finishing apparatus of claim 1, wherein said movable unit comprises a power trowel device.

15. The concrete finishing apparatus of claim 1, wherein said at least one rotatable finishing member comprises two rotatable finishing members positioned at opposite ends of said movable unit.

16. The concrete finishing apparatus of claim 15, wherein one of said two rotatable finishing members is lowerable to contact and smooth the partially cured concrete surface when said movable unit is moved in said first direction, while the other of said two rotatable finishing members is lowerable to contact and smooth the partially cured concrete surface when said movable unit is moved in a second direction, said second direction being generally opposite said first direction.

17. The concrete finishing apparatus of claim 1, wherein said at least one rotatable finishing member is mounted at said movable unit such that said longitudinal axis of said at least one rotatable finishing member is generally normal to said first direction.

18. The concrete finishing apparatus of claim 1, wherein said at least one rotatable finishing member is mounted at said movable unit such that said longitudinal axis of said at least one rotatable finishing member is canted relative to said first direction.

19. The concrete finishing apparatus of claim 1, wherein said at least one rotatable finishing member is adjustably mounted at said movable unit such that said longitudinal axis of said at least one rotatable finishing member is adjustable to adjust an angle of said at least one rotatable finishing member relative to a direction of travel of said movable unit.

20. The concrete finishing apparatus of claim 1 including a scraping device for substantially removing residue from said rotatable finishing member as said rotatable finishing member rotatably engages the partially cured concrete surface.

21. A method for finishing a concrete surface of partially cured concrete comprising:

providing a concrete finishing apparatus having a movable support and a rotatable finishing member mounted to said movable support, said rotatable finishing member defining a generally cylindrical contact surface for contacting a partially cured concrete surface;

moving said movable support along the concrete surface such that said movable support is supported on the partially cured concrete surface, said movable support being supported on the partially cured concrete by at least one support at the partially cured concrete surface;

engaging said contact surface with the partially cured concrete surface; and rotating said rotatable finishing member about a longitudinal axis of said finishing member to move said contact surface relative to the partially cured concrete surface as said movable support and said rotatable finishing member are moved along the partially cured concrete surface.

22. The method of claim 21, wherein moving said movable support includes moving said movable support in a first direction.

23. The method of claim 22, wherein rotating said rotatable finishing member includes rotating said rotatable finishing member to move an engaging portion of said contact surface in said first direction as said movable support moves in the first direction, said engaging portion engaging the partially cured concrete surface.

24. The method of claim 23 including positioning said rotatable finishing member behind said movable support as said movable support is moved in said first direction.

25. The method of claim 21, wherein rotating said rotatable finishing member includes rotating said rotatable finishing member at a speed such that said contact surface generates sufficient slippage over the partially cured concrete to smooth the concrete to a high quality finish.

26. The method of claim 21, wherein providing a concrete finishing apparatus includes providing a concrete finishing apparatus which includes a wheeled movable support having at least one wheel.

27. The method of claim 21 including adjusting a degree of down pressure exerted by said rotatable finishing member on the partially cured concrete surface.

28. The method of claim 27, wherein adjusting a degree of down pressure includes adjusting a weight of said rotatable finishing member.

29. The method or claim 21 including vertically adjusting a level of said rotatable finishing member relative to said movable support.

30. The method of claim 29, wherein vertically adjusting a level of said rotatable finishing member includes vertically adjusting a level of said rotatable finishing member in response to a laser leveling system.

31. The method of claim 21 including pivoting said rotatable finishing member about a generally vertical axis to adjust an angle of said rotatable finishing member relative to a direction of travel of said movable support.

32. The method of claim 21 including programming said concrete finishing apparatus to move and finish the partially cured concrete surface in a programmed manner.

33. A concrete finishing apparatus for smoothing and leveling partially cured concrete at a support surface comprises:

a movable unit which is movable and supported on a partially cured concrete and is movable in a first direction, said movable unit comprising at least one support that engages the surface of the partially cured concrete and supports said movable unit on the partially cured concrete; and at least one rotatable finishing member rotatably mounted at a rearward end of said movable unit as said movable unit moves in said first direction, said at least one rotatable finishing member comprising an elongated generally cylindrical member having a longitudinal axis, said cylindrical member being rotatable about said longitudinal axis in a direction generally opposite said first direction, such that a contact surface of said cylindrical member engages the partially cured concrete surface and moves relative to the partially cured concrete surface in a direction generally opposite to said first direction, said rotatable finishing member being positionable to be at least partially supported on the partially cured concrete surface.

34. The concrete finishing apparatus of claim 33 including a second rotatable finishing member mounted at a forward end of said movable unit as said movable unit moves in said first direction.

35. The concrete finishing apparatus of claim 34, wherein said movable unit is movable in a second direction, said second direction being generally opposite to said first direction.

36. The concrete finishing apparatus of claim 35, wherein said rotatable finishing member and said second rotatable finishing member are vertically adjustable relative to said movable support.

37. The concrete finishing apparatus of claim 36, wherein said rotatable finishing member is lowerable into engagement with the partially cured concrete surface at least when said movable unit is moved in said first direction.

38. The concrete finishing apparatus of claim 37, wherein said second rotatable finishing member is lowerable into engagement with the partially cured concrete surface at least when said movable unit is moved in said second direction.

39. The concrete finishing apparatus of claim 38, wherein said rotatable finishing member and said second rotatable finishing member are vertically adjustable in response to a laser leveling system.

40. The concrete finishing apparatus of claim 35, wherein said rotatable finishing member and said second rotatable finishing members are adjustable about a generally vertical axis to adjust an angle of said finishing members relative to said first and second directions.

41. The concrete finishing apparatus of claim 33, wherein said rotatable finishing member is vertically adjustable relative to said movable unit.

42. The concrete finishing apparatus of claim 41 including a laser leveling system, said rotatable finishing member being vertically adjustable in response to said laser leveling system.

43. The concrete finishing apparatus of claim 33, wherein said rotatable finishing member is variably weighted to adjust or vary an amount of force or downward pressure being applied to the partially cured concrete by said rotatable finishing member.

44. The concrete finishing apparatus of claim 33, wherein said at least one support spreads the weight of said movable unit over an area of the partially cured concrete surface to limit depression of the partially cured concrete surface by said movable unit.

45. The concrete finishing apparatus of claim 44, wherein said at least one support comprises at least one of at least one tire, at least one wheel and at least one roller.

46. The concrete finishing apparatus of claim 45, wherein said movable unit is adjustably weighted to adjust an amount of down pressure of said rotatable finishing member on the partially cured concrete surface.

47. The concrete finishing apparatus of claim 44, wherein said at least one support comprises at least four inflatable tires.

48. The concrete finishing apparatus of claim 44, wherein said at least one support comprises at least two elongated rollers which are rotatable to move said movable unit over the concrete surface.

49. The concrete finishing apparatus of claim 44, wherein said at least one support comprises at least two continuous tracks.

50. The concrete finishing apparatus of claim 33, wherein said movable unit comprises an air cushion unit which is operable to generate a cushion of air beneath said movable unit, said at least one support comprising said cushion of air.

51. The concrete finishing apparatus of claim 33, wherein said movable unit comprises a power trowel device.

52. The concrete finishing apparatus of claim 33, wherein said at least one rotatable finishing member is adjustably mounted at said movable unit such that said longitudinal axis of said at least one rotatable finishing member is adjustable to adjust an angle of said at least one rotatable finishing member relative to a direction of travel of said movable unit.

53. The concrete finishing apparatus of claim 33 including a scraping device for substantially removing residue from said rotatable finishing member as said rotatable finishing member rotatably engages the partially cured concrete surface.

* * * * *

UNITED STATES PATENT AND TRADEMARK OFFICE

CERTIFICATE OF CORRECTION

PATENT NO. : 6,695,532 B2
APPLICATION NO. : 10/166507
DATED : February 24, 2004
INVENTOR(S) : David W. Somero et al.

It is certified that error appears in the above-identified patent and that said Letters Patent is hereby corrected as shown below:

Column 17:
Line 44, Claim 1, Insert --one rotatable finishing member comprising an elongated generally cylindrical member-- after "least".

Column 18:
Line 30, Claim 12, "tacks" should be --tracks--.

Column 19:
Line 53, Claim 29, "or" should be --of--.

Signed and Sealed this

Twentieth Day of February, 2007

JON W. DUDAS
*Director of the United States Patent and Trademark Office*